US006799626B2

(12) United States Patent
Ray et al.

(10) Patent No.: US 6,799,626 B2
(45) Date of Patent: Oct. 5, 2004

(54) CASTINGS OF METALLIC ALLOYS WITH IMPROVED SURFACE QUALITY, STRUCTURAL INTEGRITY AND MECHANICAL PROPERTIES FABRICATED IN FINEGRAINED ISOTROPIC GRAPHITE MOLDS UNDER VACUUM

(75) Inventors: Ranjan Ray, Pheonix, AZ (US); Donald W. Scott, Peoria, AZ (US)

(73) Assignee: Santoku America, Inc., Tolleson, AZ (US)

( * ) Notice: Subject to any disclaimer, the term of this patent is extended or adjusted under 35 U.S.C. 154(b) by 124 days.

(21) Appl. No.: 10/143,920

(22) Filed: May 14, 2002

(65) Prior Publication Data

US 2004/0003913 A1 Jan. 8, 2004

Related U.S. Application Data

(60) Provisional application No. 60/290,647, filed on May 15, 2001, and provisional application No. 60/296,771, filed on Jun. 11, 2001.

(51) Int. Cl.[7] ..... B22C 9/00; B22C 3/00

(52) U.S. Cl. ..... 164/529; 164/519; 164/459; 164/72; 106/38.2; 427/228

(58) Field of Search ..... 164/529, 519, 164/418, 459, 72, 268; 106/38.2, 38.27, 38.9; 427/228

(56) References Cited

U.S. PATENT DOCUMENTS

| | | | | |
|---|---|---|---|---|
| 2,977,222 | A | 3/1961 | Bieber | 172/823 |
| 3,241,200 | A | 3/1966 | Lirones | 164/517 |
| 3,243,733 | A | 3/1966 | Hosman | 333/106 |
| 3,256,574 | A | 6/1966 | Lirones | |
| 3,257,692 | A | 6/1966 | Operhall | 164/517 |
| 3,265,574 | A | 8/1966 | Scolari | 600/4 |
| 3,266,106 | A | 8/1966 | Lirones | 164/517 |
| 3,296,666 | A | 1/1967 | Lirones | 164/517 |
| 3,321,005 | A | 5/1967 | Lirones | 164/518 |
| 3,389,743 | A | 6/1968 | Morozov et al. | 164/516 |
| 3,485,288 | A | 12/1969 | Zusman et al. | 164/34 |
| 3,492,197 | A | 1/1970 | Olstowski et al. | 164/24 |
| 3,519,503 | A | 7/1970 | Moore et al. | 148/514 |
| 3,547,676 | A | 12/1970 | Bokros et al. | 427/213 |
| 3,567,896 | A | 3/1971 | Chang | 219/50 |
| 3,683,996 | A | 8/1972 | Dunlop | 164/14 |
| 3,718,720 | A | 2/1973 | Lambdin, Jr. et al. | 264/29 |
| 3,781,158 | A | 12/1973 | Leghorn | 164/459 |
| 3,900,540 | A | 8/1975 | Robba et al. | 264/29.6 |
| 4,005,163 | A | 1/1977 | Bokros | 264/81 |
| 4,129,462 | A | 12/1978 | Korenko | 148/31 |
| 4,209,348 | A | 6/1980 | Duhl et al. | 148/555 |

(List continued on next page.)

FOREIGN PATENT DOCUMENTS

| | | |
|---|---|---|
| JP | 55149747 | 11/1980 |
| JP | 60040644 | 3/1985 |
| SU | 1306641 | 4/1987 |

OTHER PUBLICATIONS

USSN 10/163,345, Ranjan Ray et al., filed Jun. 7, 2002.
USSN 10/151,871, Ranjan Ray et al., filed May 22, 2002.

*Primary Examiner*—M. Alexandra Elve
*Assistant Examiner*—I. H. Lin
(74) *Attorney, Agent, or Firm*—Stevens, Davis, Miller & Mosher, LLP

(57) ABSTRACT

Methods for making various metallic alloys such as nickel, cobalt and/or iron based superalloys, stainless steel alloys, titanium alloys and titanium aluminide alloys into engineering components by melting of the alloys in a vacuum or under a low partial pressure of inert gas and subsequent casting of the melt in the graphite molds under vacuum or low partial pressure of inert gas are provided, the molds having been fabricated by machining high density, high strength ultrafine grained isotropic graphite, wherein the graphite has been made by isostatic pressing or vibrational molding.

22 Claims, 21 Drawing Sheets

U.S. PATENT DOCUMENTS

| | | | | |
|---|---|---|---|---|
| 4,226,900 | A | 10/1980 | Carlson et al. | 427/228 |
| 4,453,985 | A | 6/1984 | Gessinger et al. | 148/501 |
| 4,574,015 | A | 3/1986 | Genereux et al. | 148/677 |
| 4,579,602 | A | 4/1986 | Paulonis et al. | 148/677 |
| 4,608,192 | A | 8/1986 | Su | 252/506 |
| 4,612,062 | A | 9/1986 | Nazmy et al. | 148/501 |
| 4,627,945 | A | 12/1986 | Winkelbauer et al. | 264/29.5 |
| 4,670,201 | A | 6/1987 | Montgomery et al. | 264/26 |
| 4,719,080 | A | 1/1988 | Duhl et al. | 420/443 |
| 4,761,272 | A | 8/1988 | Hucke | 423/445 |
| 4,769,087 | A | 9/1988 | Genereux et al. | 148/677 |
| 5,026,521 | A | 6/1991 | Kajimura et al. | 420/422 |
| 5,163,498 | A | 11/1992 | Kantner et al. | 164/97 |
| 5,176,762 | A | 1/1993 | Berczik | 148/407 |
| 5,226,946 | A | 7/1993 | Diehm et al. | 75/10.14 |
| 5,489,411 | A | 2/1996 | Jha et al. | 419/3 |
| 5,525,276 | A | 6/1996 | Okuyama et al. | 264/29.3 |
| 5,630,465 | A | 5/1997 | Feagin | 164/361 |
| 5,665,262 | A | 9/1997 | Hajaligol et al. | 219/553 |
| 5,705,139 | A | 1/1998 | Stiller et al. | 423/445 R |
| 5,924,470 | A | 7/1999 | Costilla-Vela et al. | 164/4.1 |
| 5,964,091 | A | 10/1999 | Fukui et al. | 60/752 |
| 6,572,815 | B1 * | 6/2003 | Ju et al. | 420/421 |

* cited by examiner

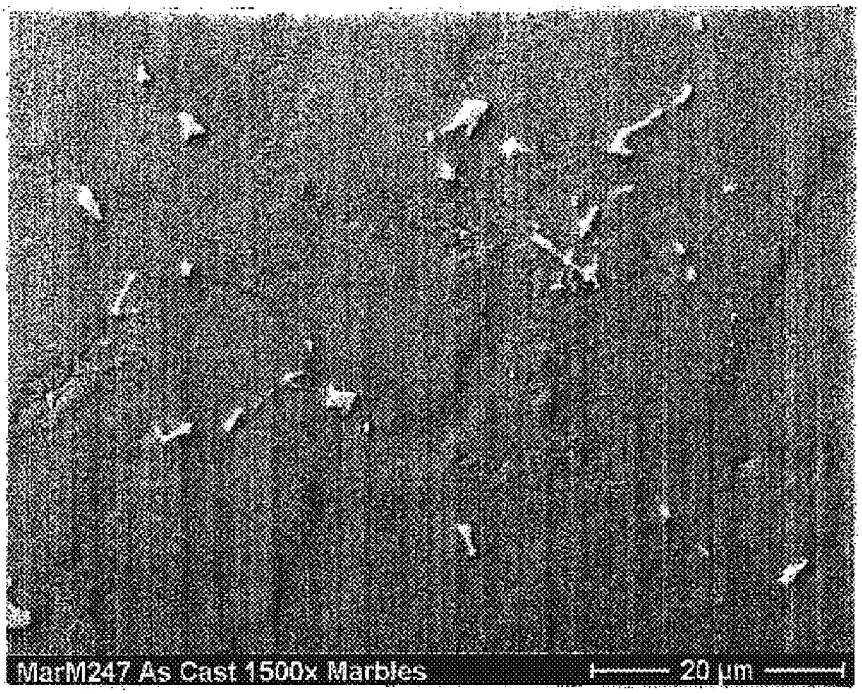
MICROSTRUCTURE (BULK AREA)
FIG. 10A
FIG. 10B
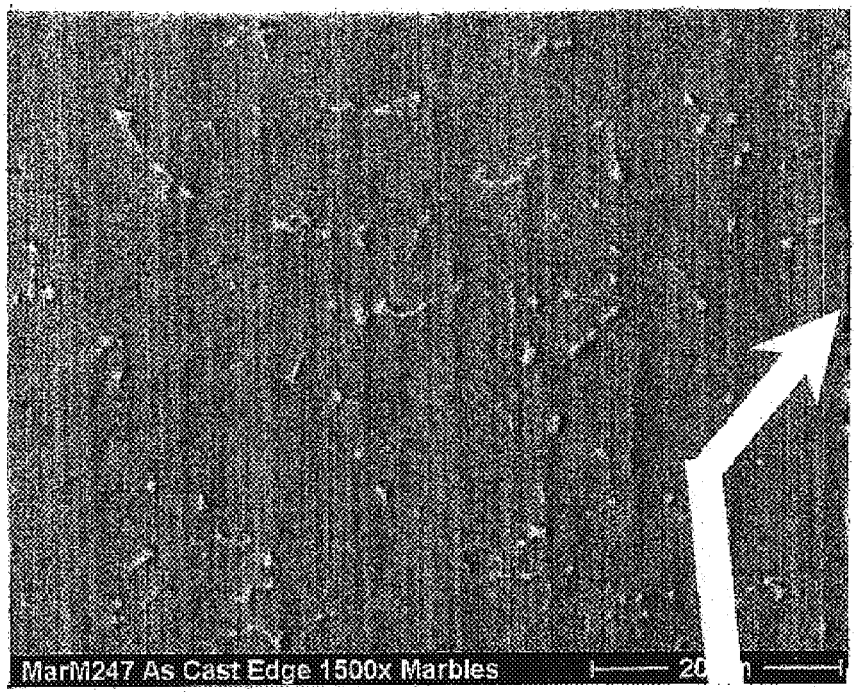
MICROSTRUCTURE NEAR THE MOLD-MELT INTERFACE

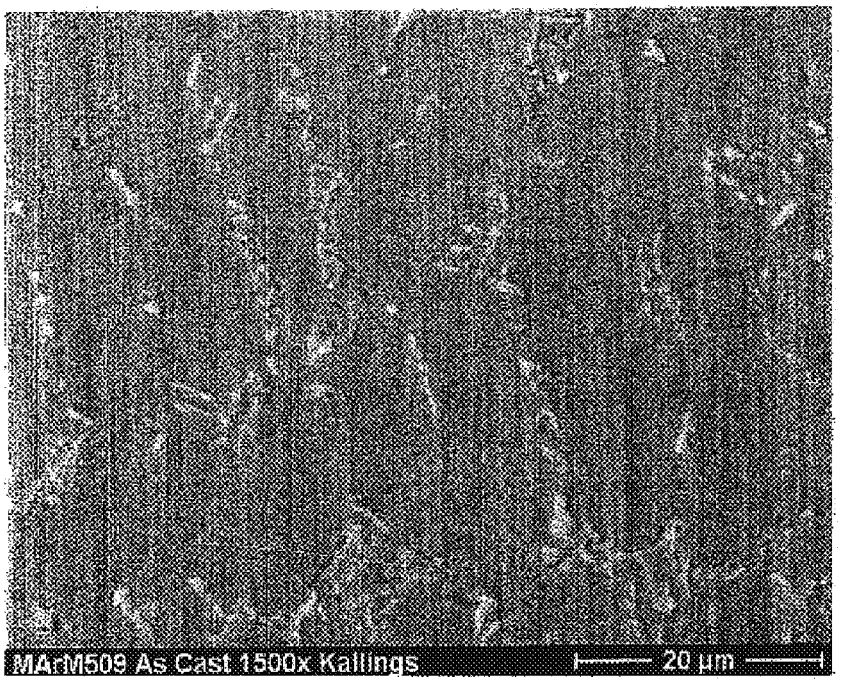
MICROSTRUCTURE (BULK AREA)
FIG. 11A
FIG. 11B
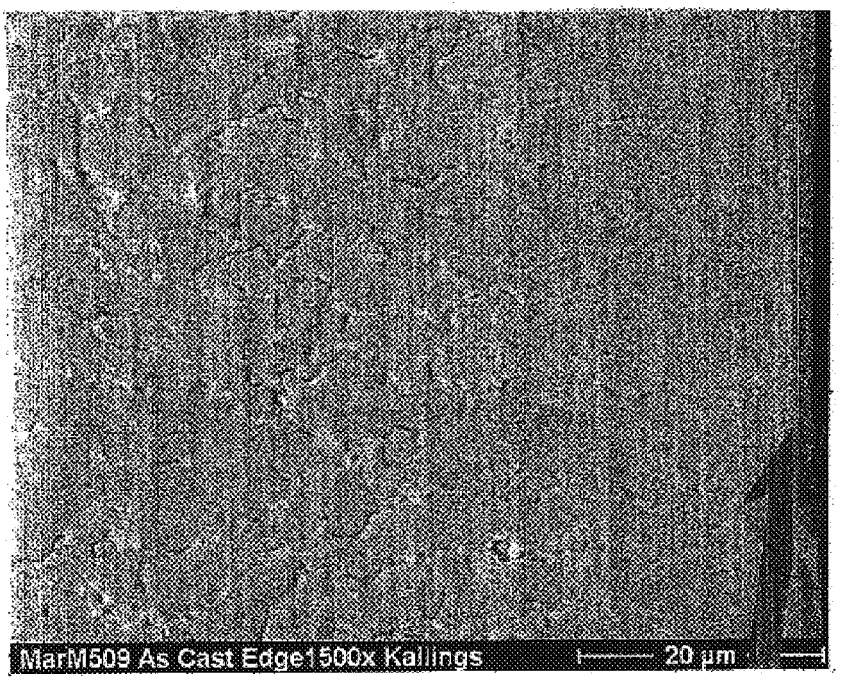
MICROSTRUCTURE NEAR THE MOLD-MELT INTERFACE

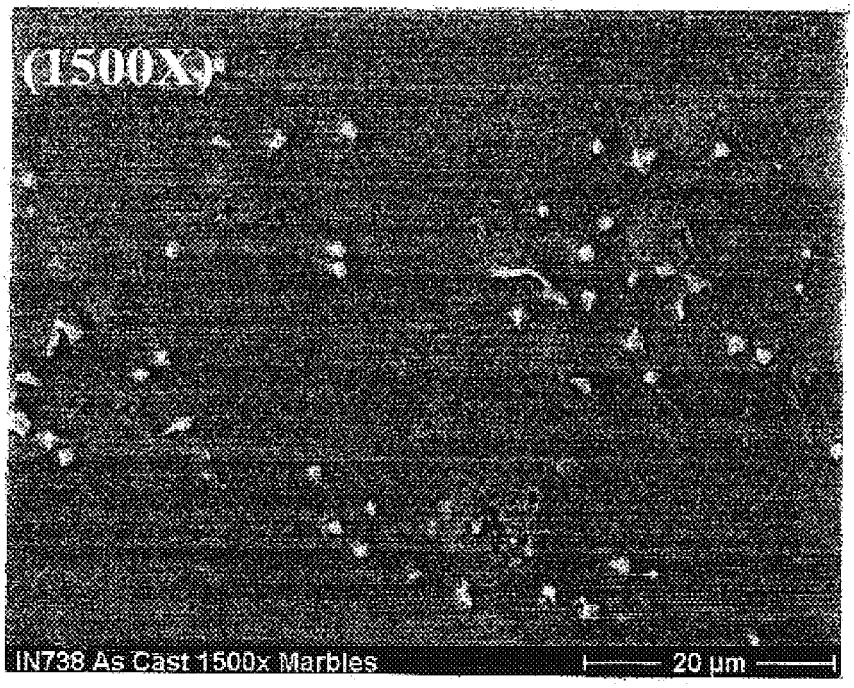
MICROSTRUCTURE (BULK AREA)
FIG. 12A
FIG. 12B
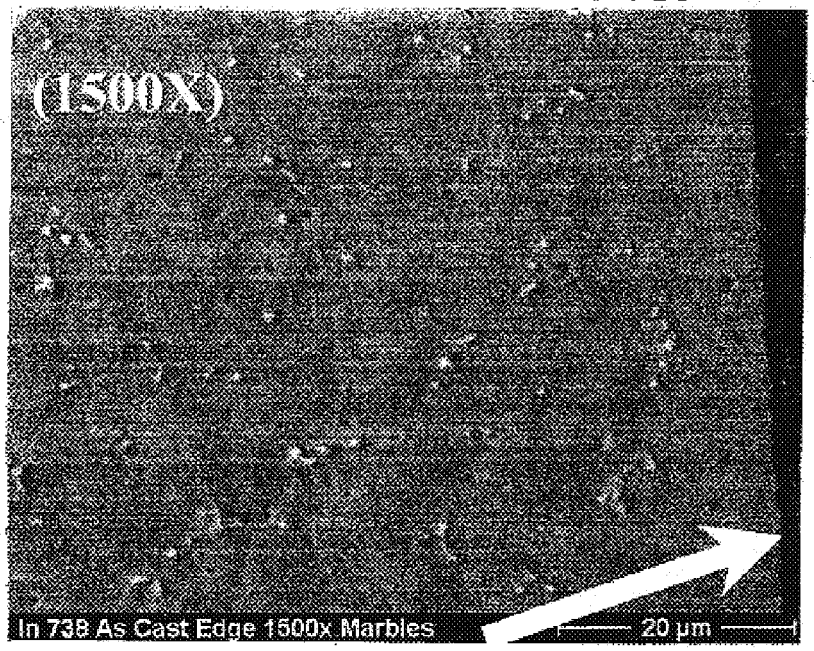
MICROSTRUCTURE NEAR THE MOLD-MELT INTERFACE

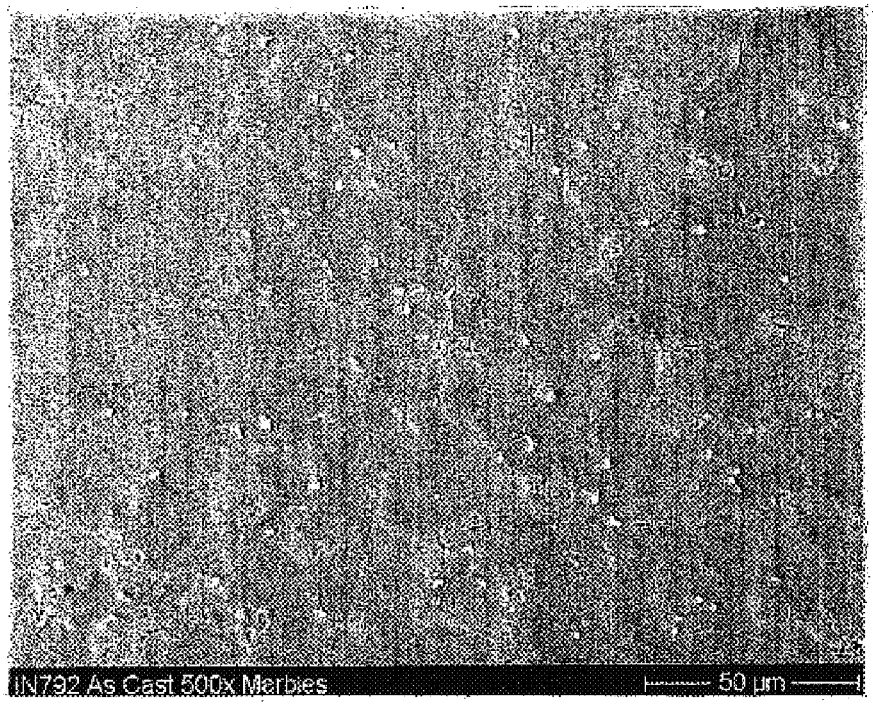
MICROSTRUCTURE (BULK AREA)
FIG. 13A
FIG. 13B
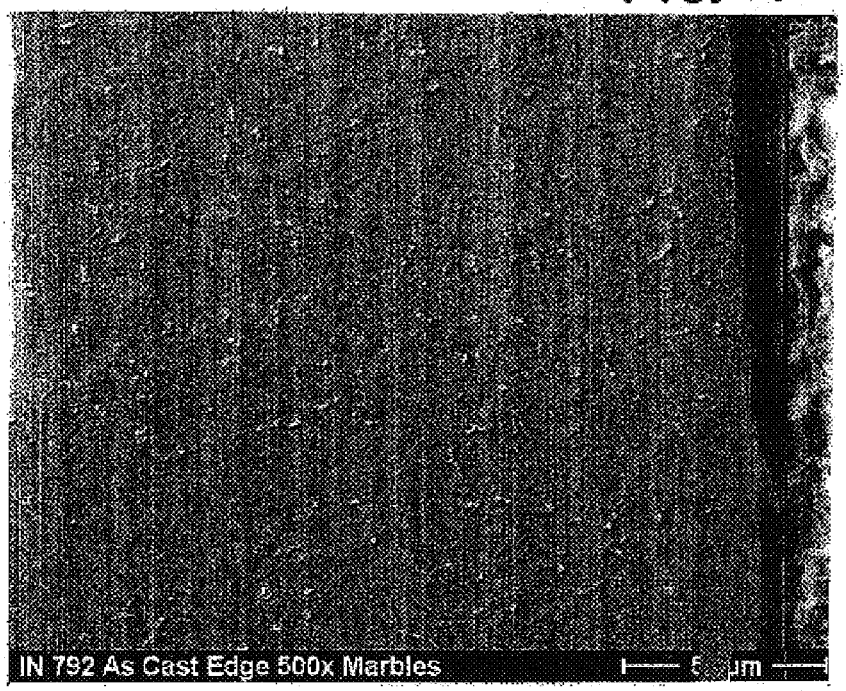
MICROSTRUCTURE NEAR THE MOLD-MELT INTERFACE

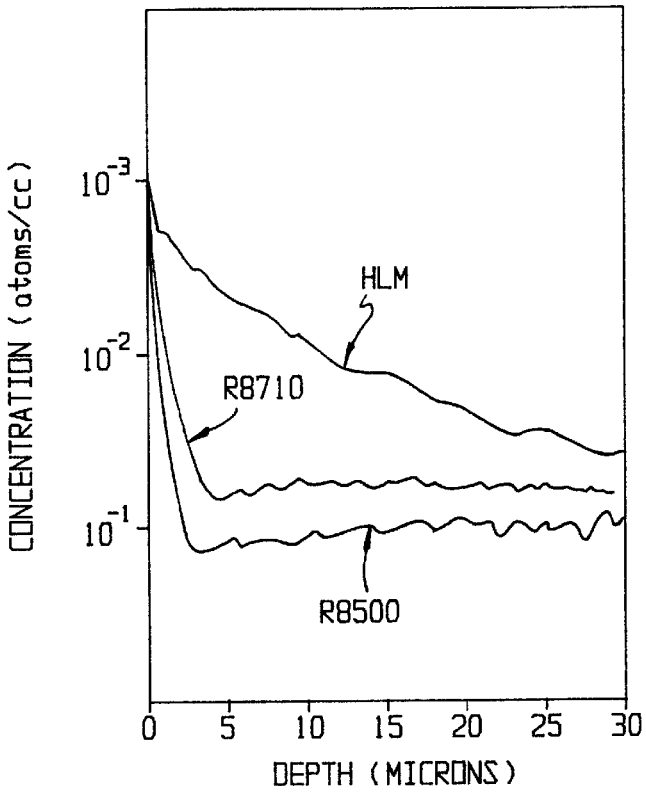
FIG. 14 CARBON PROFILES IN IN939 ALLOY CAST IN GRAPHITE MOLDS OF DIFFERENT GRADES
FIG. 19
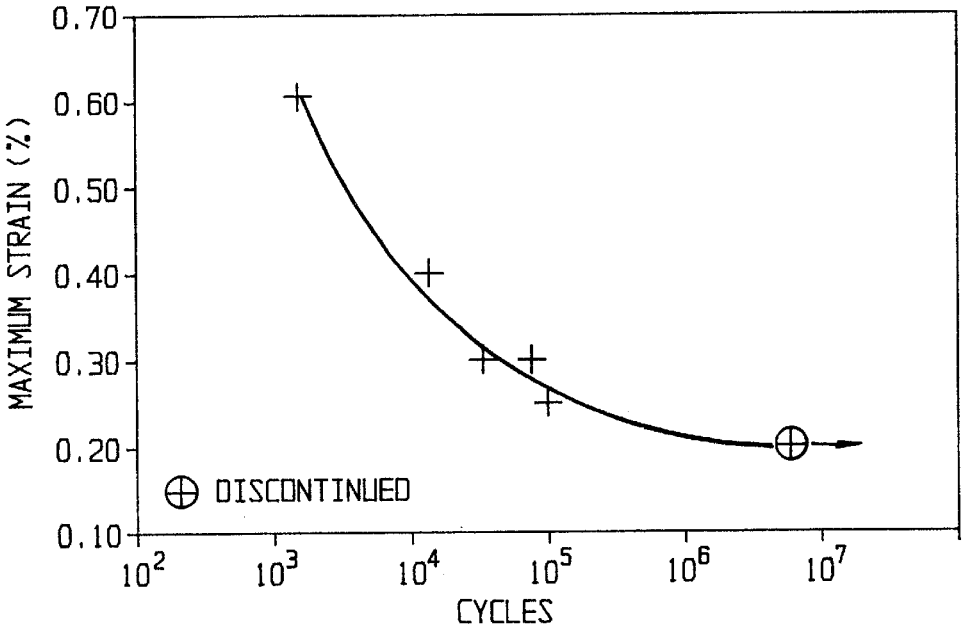

1 INCH THICK CASING (50X)

0.75 INCH THICK CASING (50X)

1 INCH THICK CASING (600X)

0.75 INCH THICK CASING (600X)

CASTINGS OF METALLIC ALLOYS WITH IMPROVED SURFACE QUALITY, STRUCTURAL INTEGRITY AND MECHANICAL PROPERTIES FABRICATED IN FINEGRAINED ISOTROPIC GRAPHITE MOLDS UNDER VACUUM

CROSS-REFERENCE TO RELATED APPLICATIONS

This claims priority from U.S. provisional patent applications Ser. Nos. 60/290,647 filed May 15, 2001 and 60/296,771 filed Jun. 11, 2001, both of which are incorporated herein by reference in their entirety.

I. FIELD OF THE INVENTION

The invention relates to methods for making various metallic alloys such as nickel, cobalt and iron based superalloys, stainless steel alloys, titanium alloys and titanium aluminide alloys into engineering components by melting of the alloys in a vacuum or under a low partial pressure of inert gas and subsequent casting of the melt in molds machined from fine grained high density, high strength isotropic graphite molds under vacuum or under a low partial pressure of inert gas.

II. BACKGROUND OF THE INVENTION

There is a need for improving the molding of various metallic alloys such as nickel, cobalt and iron based superalloys, nickel aluminides, stainless steel alloys, titanium alloys, titanium aluminide alloys, zirconium and zirconium base alloys. Metallic superalloys of highly alloyed nickel, cobalt, and/or iron based superalloys are difficult to fabricate by forging or machining. Moreover, conventional investment molds are used only one time for fabrication of castings of metallic alloys such as nickel, cobalt and iron based superalloys, stainless steel alloys, titanium alloys and titanium aluminide alloys. This increases the cost of production.

The term superalloy is used in this application in conventional sense and describes the class of alloys developed for use in high temperature environments and typically having a yield strength in excess of 100 ksi at 1000 degrees F. Nickel base superalloys are widely used in gas turbine engines and have evolved greatly over the last 50 years. As used herein the term superalloy will mean a nickel base superalloy containing a substantial amount of the gamma prime ($Ni_3$ Al) strengthening phase, preferably from about 30 to about 50 volume percent of the gamma prime phase. Representative of such class of alloys include the nickel base superalloys, many of which contain aluminum in an amount of at least about 5 weight % as well as one or more of other alloying elements, such as titanium, chromium, tungsten, tantalum, etc. and which are strengthened by solution heat treatment. Such nickel base superalloys are described in U.S. Pat. No. 4,209,348 to Duhl et al. and U.S. Pat. No. 4,719,080, both of which are incorporated herein by reference. Other nickel base superalloys are known to those skilled in the art and are described in the book entitled "Superalloys II" Sims et al., published by John Wiley & Sons, 1987, incorporated herein by reference.

Other references, incorporated herein by reference and related to superalloys and their processing, are cited below:

"Investment-cast superalloys challenge wrought materials" from Advanced Materials and Process, No. 4, pp. 107–108 (1990). "Solidification Processing", editors B. J. Clark and M. Gardner, pp. 154–157 and 172–174, McGraw-Hill (1974).

"Phase Transformations in Metals and Alloys", Van Nostrand Reinhold, D. A. Porter, p. 234 (1981).

Nazmy et al., The Effect of Advanced Fine Grain Casting Technology on the Static and Cyclic Properties of IN713LC. Conf: High Temperature Materials for Power Engineering 1990, pp. 1397–1404, Kluwer Academic Publishers (1990).

Bouse & Behrendt, Mechanical Properties of Microcast-X Alloy 718 Fine Grain Investment Castings. Conf: Superalloy 718: Metallurgy and Applications 1989, Publ:TMS, pp. 319–328 (1989).

Abstract of U.S.S.R. Inventor's Certificate 1306641 (Published Apr. 30, 1987).

WPI Accession No. 85-090592/85 & Abstract of JP 60-40644 (KAWASAKI) (Published Mar. 4, 1985).

WPI Accession No. 814-06485D/81 & Abstract of JP 55-149747 (SOGO) (Published Nov. 21, 1980).

Fang, J: Yu, B Conference: High Temperature Alloys for Gas Turbines, 1982, Liege, Belgium, Oct. 4–6, 1982, Publ: D. Reidel Publishing Co., P.O. Box 17, 3300 AA Dordrecht, The Netherlands, pp. 987–997 (1982).

Processing techniques for superalloys have also evolved and many of the newer processes are quite costly.

U.S. Pat. No. 3,519,503 incorporated herein by reference describes an isothermal forging process for producing complex superalloy shapes. This process is currently widely used, and as currently practiced requires that the starting material be produced by powder metallurgy techniques. The reliance on powder metallurgy techniques makes this process expensive.

U.S. Pat. No. 4,574,015 incorporated herein by reference deals with a method for improving the forgeability of superalloys by producing overaged microstructures in such alloys. The γ' (gamma prime) phase particle size is greatly increased over that which would normally be observed.

U.S. Pat. No. 4,579,602 deals with a superalloy forging sequence that involves an overage heat treatment.

U.S. Pat. No. 4,769,087 describes another forging sequence for superalloys.

U.S. Pat. No. 4,612,062 describes a forging sequence for producing a fine grained article from a nickel base superalloy.

U.S. Pat. No. 4,453,985 describes an isothermal forging process, which produces a fine grain product.

U.S. Pat. No. 2,977,222 describes a class of superalloys similar to those to which the invention process has particular applicability.

Titanium based alloys are also valuable for high performance uses. The major use of titanium castings is in the aerospace, chemical and energy industries. The aerospace applications generally require high performance cast parts, while the chemical and energy industries primarily use large castings where corrosion resistance is a major consideration in design and material choice.

The combination of high strength-to-weight ratio, excellent mechanical properties, and corrosion resistance makes titanium the best material for many applications. Titanium alloys are used for static and rotating gas turbine engine components. Some of the most critical and highly stressed civilian and military airframe parts are made of these alloys.

The use of titanium has expanded in recent years from applications in food processing plants, from oil refinery heat exchangers to marine components and medical prostheses. However, the high cost of titanium alloy components may limit their use. The relatively high cost is often fabricating costs, and, usually most importantly, the metal removal costs incurred in obtaining the desired end-shape. As a result, in recent years a substantial effort has been focused on the development of net shape or near-net shape technologies such as powder metallurgy (PM), superplastic forming (SPF), precision forging, and precision casting. Precision casting is by far the most fully developed and the most widely used net shape technology. Titanium castings present certain advantages. The microstructure of as-cast titanium is desirable for many mechanical properties. It has good creep resistance, fatigue crack growth resistance, fracture resistance and tensile strength.

The casting of titanium and titanium alloys presents a special problem due to the high reactivity of the material in the molten state. This requires special melting, mold-making practices, and equipment to prevent alloy contamination.

The titanium casting industry is still in an early stage of development. Because of highly reactive characteristics of titanium with ceramic materials, expensive mold materials (yttrium, throe and zircon) are used to make investment molds for titanium castings. The titanium castings develop a contaminated surface layer due to reaction with hot ceramic mold and molten titanium. This surface layer needs to be removed by some expensive chemical milling in acidic solutions containing hydrofluoric acid). Strict EPA regulations have to be followed to pursue chemical milling.

For example, U.S. Pat. No. 5,630,465 to Feagin, incorporated herein by reference, discloses ceramic shell molds made from yttria slurries, for casting reactive metals. This patent is incorporated herein by reference.

The use of graphite in investment molds has been described in U.S. Pat. Nos. 3,241,200; 3,243,733; 3,256,574; 3,266,106; 3,296,666 and 3,321,005 all to Lirones and all incorporated herein by reference. U.S. Pat. Nos. 3,257,692 to Operhall; U.S. Pat. No. 3,485,288 to Zusman et al.; and U.S. Pat. No. 3,389,743 to Morozov et al. disclose carbonaceous mold surface utilizing graphite powders and finely divided inorganic powders termed "stuccos" and are incorporated herein by reference.

U.S. Pat. No. 4,627,945 to Winkelbauer et al., incorporated herein by reference, discloses injection molding refractory shroud tubes made from alumina and from 1 to 30 weight percent calcined fluidized bed coke, as well as other ingredients. The '945 patent also discloses that it is known to make isostatically-pressed refractory shroud tubes from a mixture of alumina and from 15 to 30 weight percent flake graphite, as well as other ingredients.

III. PREFERRED OBJECTS OF THE PRESENT INVENTION It is an object of the invention to cast alloys in isotropic fine grained graphite molds.

It is another object of the present invention to cast nickel, cobalt and iron base superalloys in isotropic fine grained graphite molds.

It is another object of the present invention to cast nickel aluminide alloys in isotropic fine grained graphite molds.

It is another object of the present invention to cast stainless steels in isotropic fine grained graphite molds.

It is another object of the present invention to cast titanium and titanium alloys in isotropic fine grained graphite molds.

It is another object of the present invention to cast titanium aluminides in isotropic fine grained graphite molds.

It is another objective of the present invention to cast zirconium and zirconium alloys in isotropic fine grained graphite molds.

It is another object of the present invention to provide isotropic graphite molds.

These and other objects of the present invention will be apparent from the following description.

IV. SUMMARY OF THE INVENTION

This invention relates to a process for making various metallic alloys such as nickel, cobalt and iron based superalloys, stainless steel alloys, titanium alloys and titanium aluminide alloys as engineering components by vacuum induction melting of the alloys and subsequent casting of the melt in graphite molds under vacuum. More particularly, this invention relates to the use of high density ultrafine grained isotropic graphite molds, the graphite of very high purity (containing negligible trace elements) being made via the isostatic pressing route. High density (>1.77 gm/cc), small porosity (<13%), high flexural strength (>7,000 psi), high compressive strength (>9,000 psi) and fine grains (<10 micron) are some of the characteristics of isostatically pressed graphite that render it suitable for use as molds for casting superalloys. The other important properties of the graphite material are high thermal shock, wear and chemical resistance, and minimum wetting by liquid metal. The extruded graphites which have lower density (<1.72 gm/cc), lower flexural strength (<3,000 psi), high porosity (>20%), lower compressive strength (<8,000 psi) and coarse grains (>200 microns) have been found to be less suitable as molds for casting iron, nickel and cobalt base superalloys.

The present invention has a number of advantages:

(1) Use of ultrafine grained isotropic graphite molds to fabricate superalloy castings improves quality and achieves superior mechanical properties compared to castings made by a conventional investment casting process.

(2) The molds can be used repeatedly many times thereby reducing significantly the cost of fabrication of castings compared to traditional process.

(3) Near net shape parts can be cast, eliminating subsequent operating steps such as machining.

(4) The castings can be made in molds held at room or low temperatures resulting in finer grain structures and improved mechanical properties.

V. BRIEF OF DESCRIPTION OF THE DRAWINGS

FIGS. 10A and 10B, respectively, show SEM pictures of Mar-M-247 (as cast) cast in isotropic graphite mold to show the microstructure of a bulk area and microstructure near the mold-melt interface.

FIGS. 11A and 11B, respectively, show SEM pictures of Mar-M-509 (as cast) cast in isotropic graphite mold to show the microstructure of a bulk area and microstructure near the mold-melt interface.

FIGS. 12A and 12B, respectively, show SEM pictures of IN 738 (as cast) cast in isotropic graphite mold to show the microstructure of a bulk area and microstructure near the mold-melt interface.

FIGS. 13A and 13B, respectively, show SEM pictures of IN 792 (as cast) cast in isotropic graphite mold to show the microstructure of a bulk area and microstructure near the mold-melt interface.

FIG. 14 shows carbon concentration profiles, in IN 939 alloy cast in graphite molds of different grades, as a function of depth.

Figure 15:
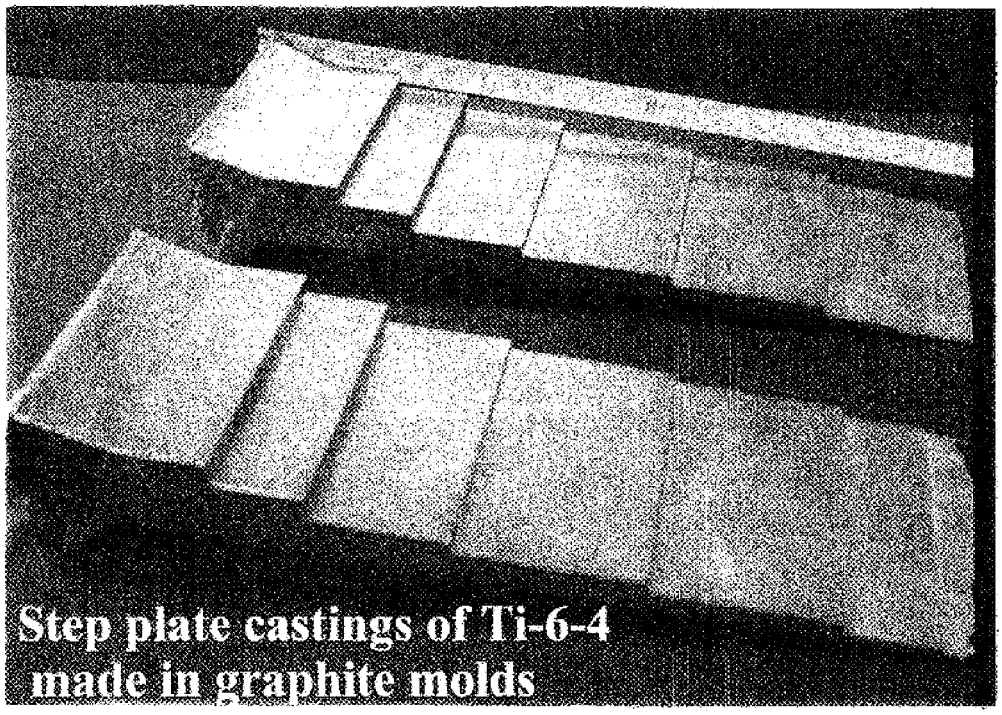

FIG. 15 shows the Ti-6Al-4V titanium step plate castings made in isotropic graphite molds. Each step plate is 7 inches wide by 20 inches long with multiple steps with thicknesses ranging between 2 inches to one eighth inch.

Figure 16:
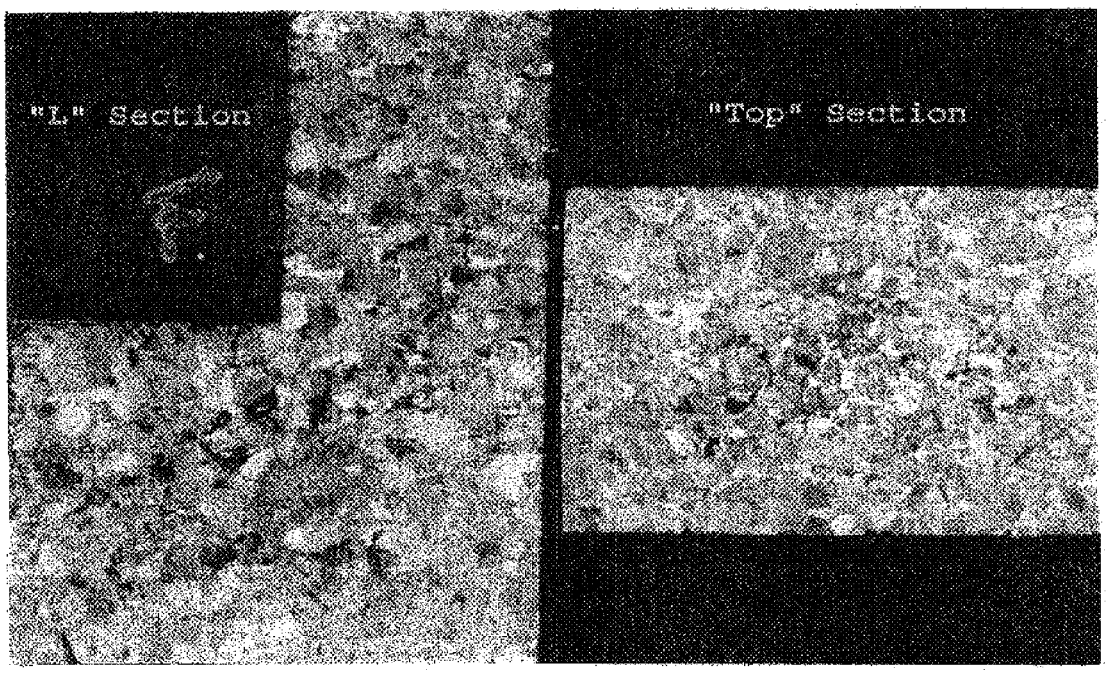

FIG. 16 shows the macro-etched structure of a Ti-6Al-4V step plate casting.

Figure 17A:
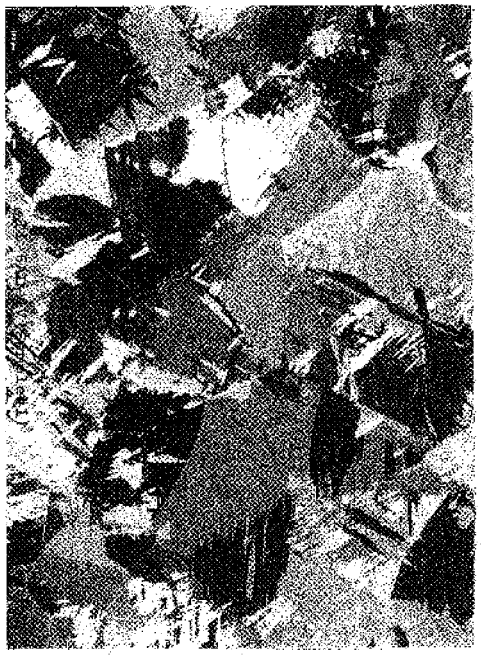
Figure 17B:
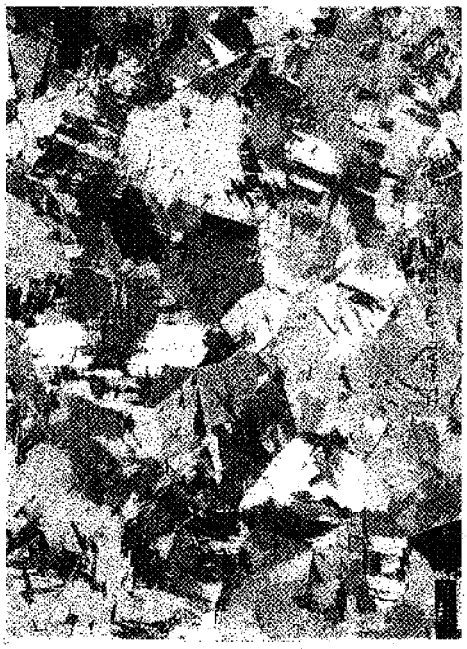

FIGS. 17A and 17B, respectively show the microstructure of the bulk areas from the Ti-6Al-4V step plate cast in an isotropic mold with 1 inch and 0.75 inch thickness.

Figure 18A:
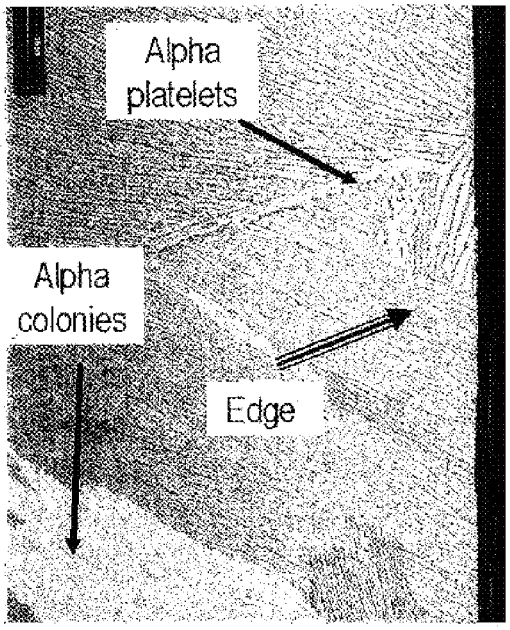
Figure 18B:
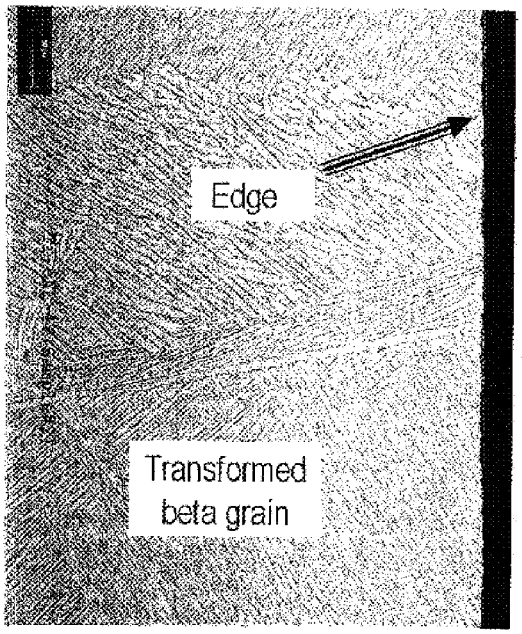

FIGS. 18A and 18B, respectively, show the typical microstructures of the castings near the edges from the Ti-6Al-4V step plate cast in an isotropic mold with 1 inch and 0.75 inch thickness.

FIG. 19 plots the results of low cycle fatigue tests carried out on specimens obtained from a Ti-6Al-4V plate casting of Example 7 cast in an isotropic graphite mold.

Figure 20:
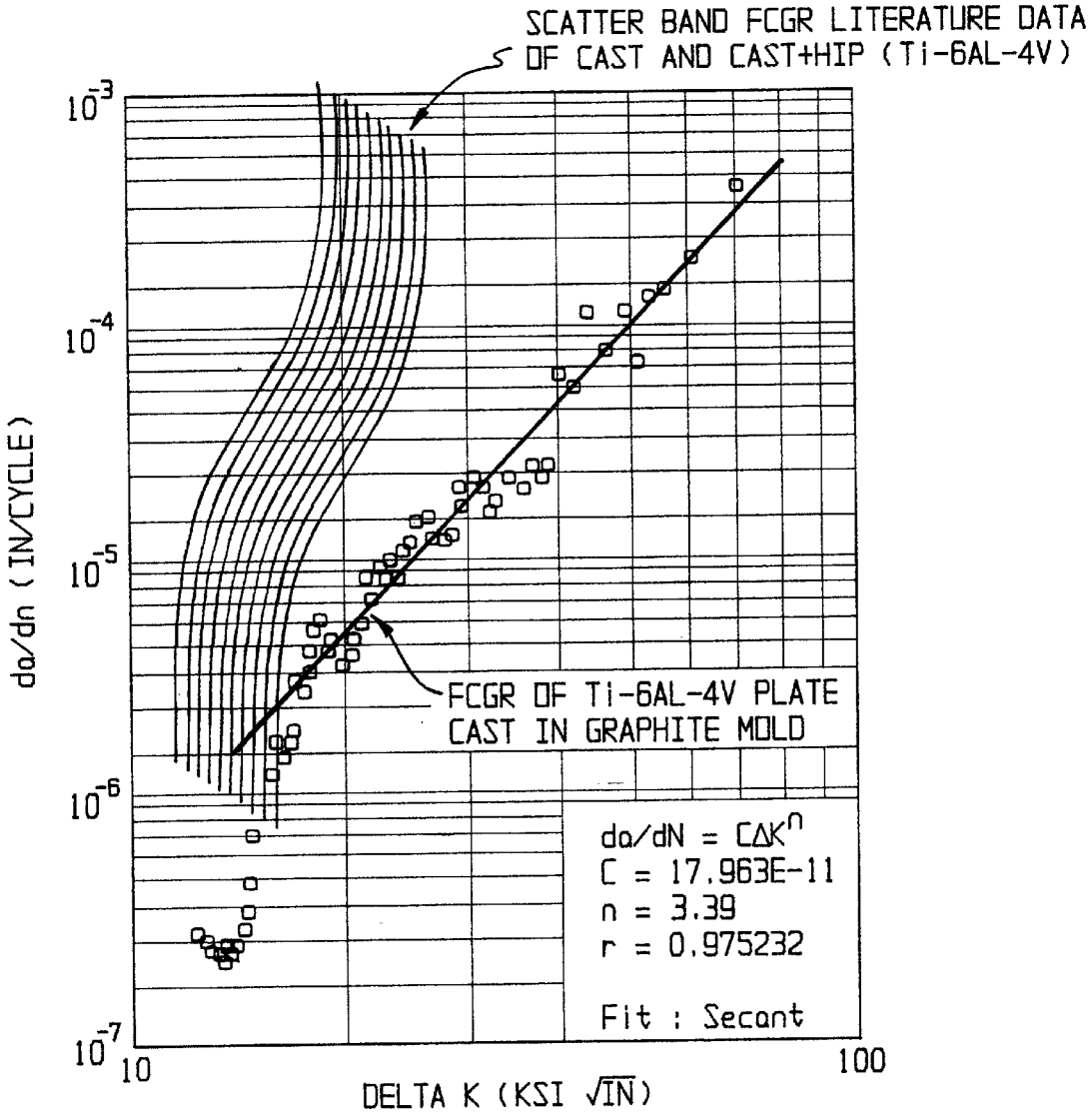

FIG. 20 plots low cycle fatigue properties of a Ti-6Al-4V plate casting made in isotropic graphite plate as the results of fatigue crack growth rate (FCGR) tested according to the procedures of ASTM E 647-00 for a compact tension specimen machined from the Ti-6Al-4V plate casting of Example 7.

Figure 21:
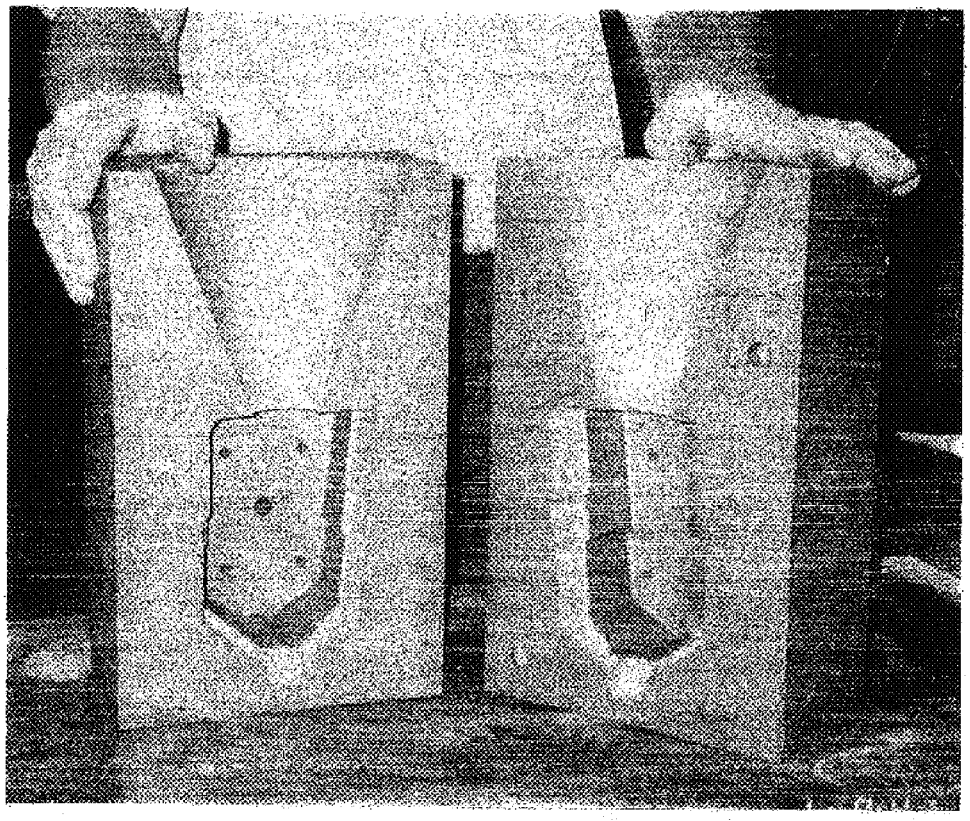

FIG. 21 shows an isotropic graphite mold for casting an airframe titanium alloy hinge as a net shaped part.

Figure 22:
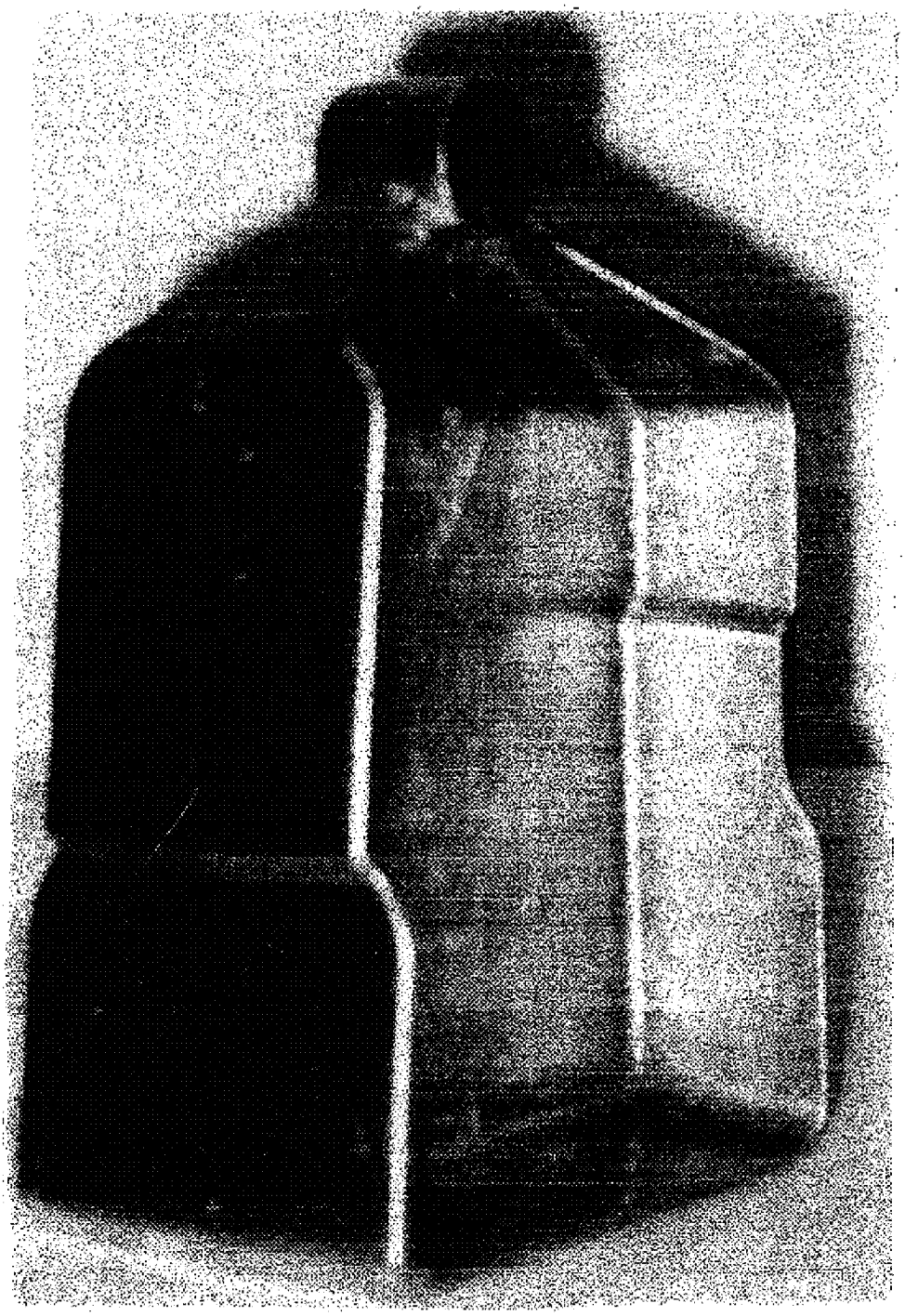

FIG. 22 shows a Ti-6Al-4V titanium alloy airframe hinge made in an isotropic graphite mold.

Figure 23:
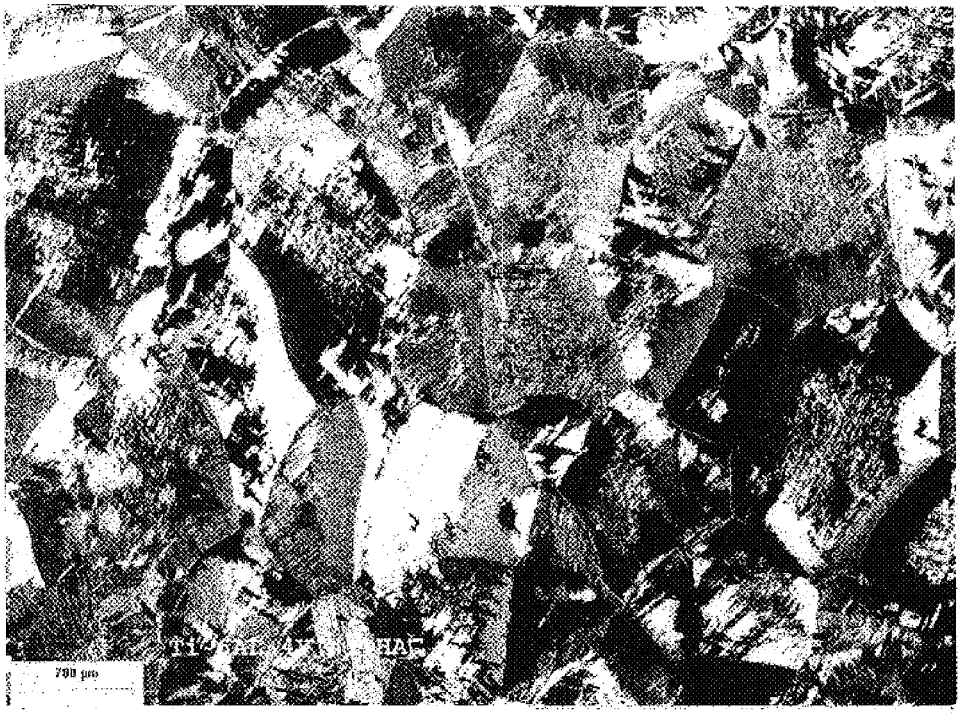

FIG. 23 shows as cast uniform microstructure of the hinge casting made of Ti-6Al-4V alloy in an isotropic graphite mold.

Figure 24A:
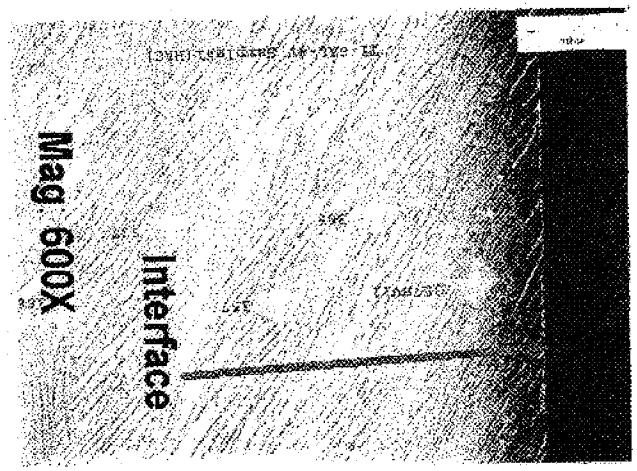
Figure 24B:
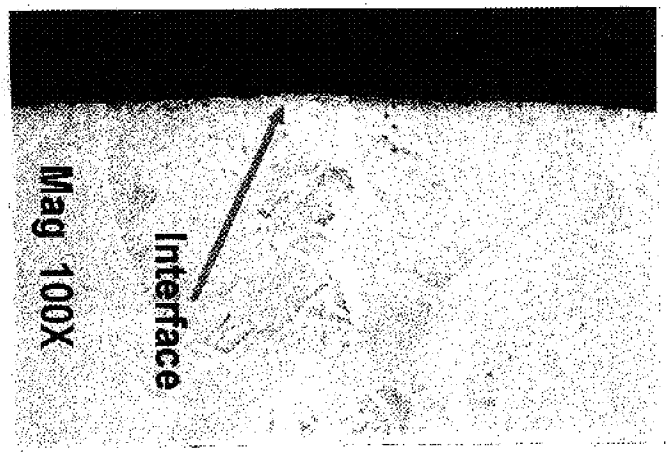

FIGS. 24A and 24B show photographs developed by standard optical metallographic techniques showing the microstructures of a Ti-6Al-4V hinge casting near a graphite mold metal interface.

Figure 25:
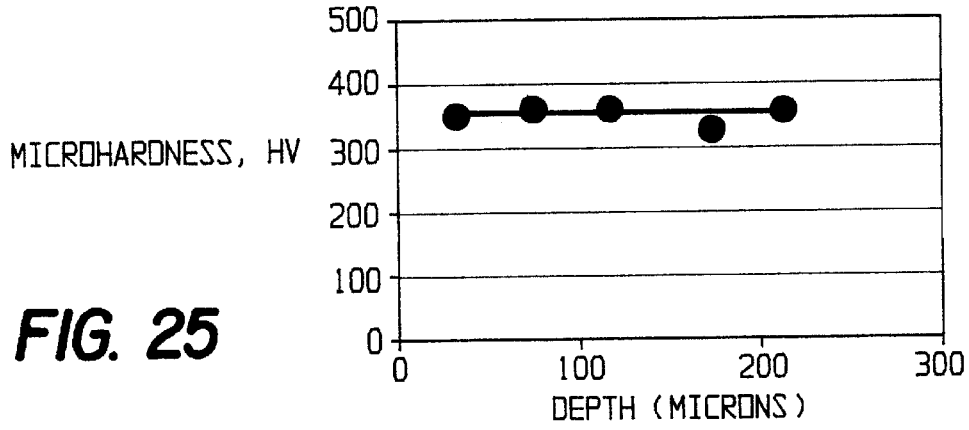

FIG. 25 shows the microhardness profile as a function of depth near the outer surface of the Ti-6Al-4V hinge casting made in an isotropic graphite mold.

Figure 26:
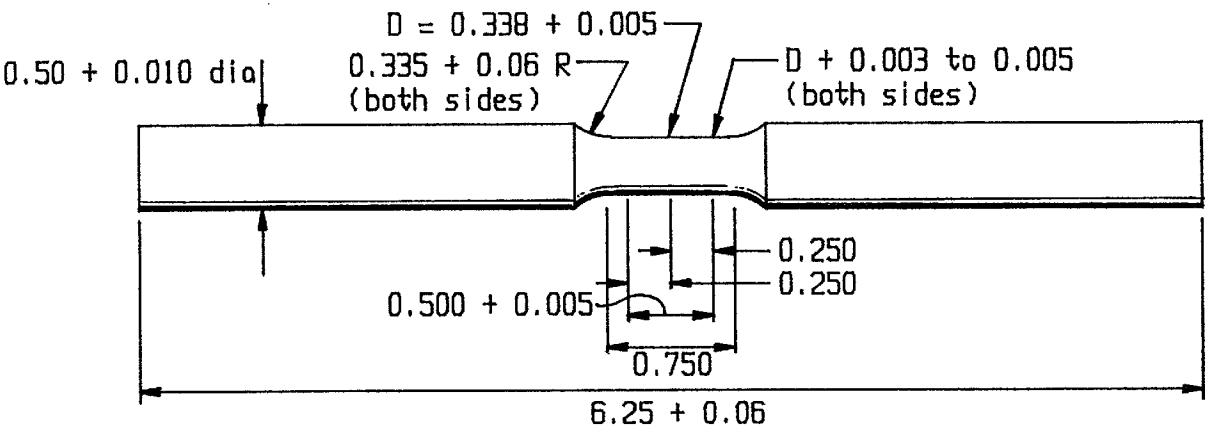

FIG. 26 shows a side view of a cyclic stress strain fatigue specimen of Example 9.

Figure 27A:
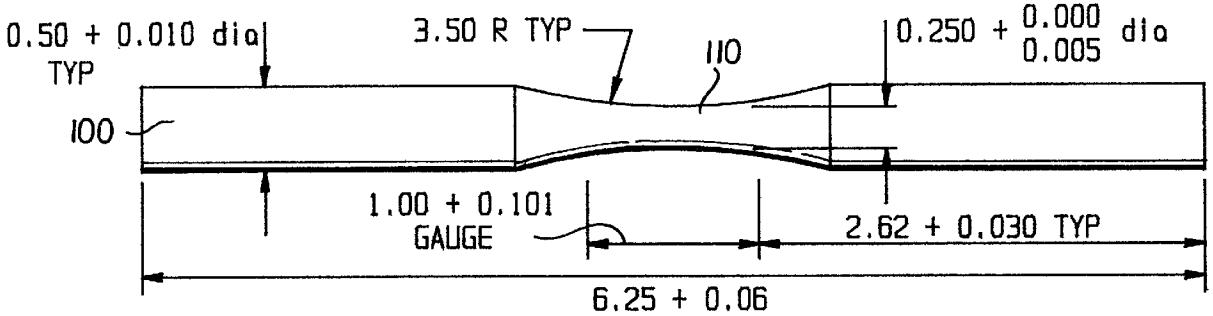

FIG. 27A shows a side view of a cyclic stress strain fatigue specimen 100 of Example 10.

Figure 27B:
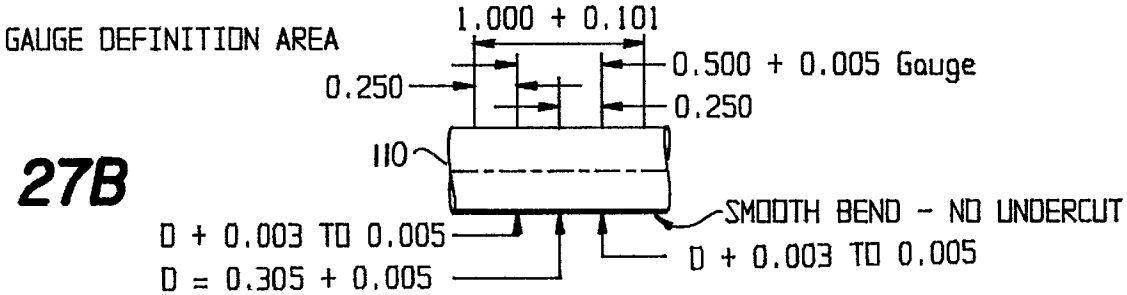

FIG. 27B shows an enlarged view of a portion 110 of the cyclic stress strain fatigue specimen 100 of FIG. 27A.

VI. DETAIL DESCRIPTION OF THE PREFERRED EMBODIMENTS

A. Graphite

The graphite in the mold is high density ultrafine grained graphite molds, the graphite of very high purity (containing negligible trace elements) being made via the isostatic pressing route. Bulk density between 1.65 and 1.9 gm/cc (preferably >1.77 gm/cc), small porosity of <15% (preferably <13% ), high flexural strength of between 5,500 and 20,000 psi (preferably >7,000 psi), high compressive strength of >9,000 psi (preferably between 12,000 and 35,000 psi) and fine isotropic grains having particle sizes from 3 to 40 microns (preferably <10 micron) are some of the characteristics of isostatically pressed graphite that render it suitable for use as molds for casting superalloys. The other important properties of the graphite material are high thermal shock, wear and chemical resistance, and minimum wetting by liquid metal. The extruded graphite which has lower density (<1.72 gm/cc), lower flexural strength (<3,000 psi), high porosity (>20%), lower compressive strength (<8,000 psi) and coarse grains (>200 microns) have been found to be less suitable as molds for casting iron, nickel and cobalt base superalloys.

Density is the ratio of the mass to the volume of material including open and closed pores. Density is measured according to ASTM C-838.

Compressive properties describe the behavior of a material when it is subjected to a compressive load. Loading is at a relatively low and uniform rate. Compressive strength and modulus are the two most common values produced.

Compressive strength is stress required to cause ultimate fracture under compressive load. Test procedures correspond to ASTM C-695. The specimen is placed between compressive plates parallel to the surface. The specimen is then compressed at a uniform rate. The maximum load is recorded along with stress-strain data. An extensometer attached to the front of the fixture is used to determine modulus.

Specimens can either be blocks or cylinders. The typical blocks are 12.7×12.7×25.4mm (½ by ½ by 1 in). and the cylinders are 12.7 mm (½ in) in diameter and 25.4 mm (1 in) long.

Compressive strength and modulus are two useful calculations.

Compressive strength=maximum compressive load/minimum cross sectional area.

Compressive modulus=change in stress/change in strain.

Flexural strength of graphite is the maximum stress that a sample will withstand in bending before rupture. Graphite is typically tested using four-point loading according to the ASTM C 651.

Flexural modulus is used as an indication of a material's stiffness when flexed.

Most commonly the specimen lies on a support span and the load is applied to the center by the loading nose producing three point bending at a specified rate.

The parameters for this test are the support span; the speed of the loading; and the maximum deflection for the test. A variety of specimen shapes can be used for this test, but the most commonly used specimen size is 3.2 mm×12.7 mm×64 mm (0.125"×0.5"×2.5") for measurement of flexural strength, flexural stress at specified strain levels, and flexural modulus.

Apparent porosity is the ratio of the volume of open pores to the apparent total volume of the material expressed as a percentage. This corresponds to ASTM C-830.

References relating to isotropic graphite include U.S. Pat. Nos. 4,226,900 to Carlson, et al, U.S. Pat. No. 5,525,276 to Okuyama et al, and U.S. Pat. No. 5,705,139 to Stiller, et al., all incorporated herein by reference.

Isotropic graphite made via isostatic pressing has fine grains (3–40 microns) whereas extruded graphite is produced from relative coarse carbon particles resulting into coarse grains (400–1200 microns). Isostropic graphite has much higher strength, and structural integrity than extruded graphite due to the presence of extremely fine grains, higher density and lower porosity, as well as the absence of "loosely bonded" carbon particles. Extruded graphite has higher thermal conductivity due to anisotropic grain structure formed during extrusion.

Another premium grade of graphite suitable for use as permanent molds for casting various superalloys, titanium and titanium aluminide alloys with high quality is a copper impregnated "isostatic" graphite, R8650C from SGL Graphite Company. It has excellent density, microfine grain size and can be machined/ground to an extremely smooth finish.

Another grade of graphite suitable for use as permanent molds for casting superalloys, titanium, titanium alloys and titanium aluminides, nickel aluminides is isotropic fine grained graphite made by vibration molding.

The molds used to perform experiments according to the present invention were made with isostatically pressed isotropic graphite as well as extruded anisotropic graphite. The graphite used in the experiments was made by SGL Carbon Group.

Isotropic fine grained graphite is synthetic material produced by the following steps:

(1) Fine grained coke extracted from mines is pulverized into fine particles, separated from ashes and purified by flotation techniques. The pulverized fine particles of coke are mixed with binders (tar) and homogenized.

(2) The mixture is isostatically pressed into green compacts at room temperature (3) The green compacts are baked at 1200° C. causing carbonizing and densification. The binder is converted into carbon. The baking process binds the original carbon particles together (similar to the process of sintering of metal powders) into a solid mass.

(4) The densified carbon part is then graphitized at 2600° C. Graphitization is the formation of ordered graphite lattice from carbon. The carbon from the binder around the grain boundaries is also converted in graphite. The final product is nearly 100% graphite (the carbon from the binder is all converted in graphite during graphitization).

The average particle size of starting pulverized coke powders that are used to make green compacts in the above mentioned process will determine the final properties such as density, porosity, compressive strength and flexural strength of isotropic graphite. The finer the average particle size of the staring coke powders, the higher will be the density, compressive strength and flexural strength of the final product, i.e. isotropic graphite.

The range of average particle size of the starting coke powders in the process of manufacturing isotropic graphite range between 3 to 40 microns.

The isotropic graphite produced from coke powders with the particle size of the above stated lower limit i.e. 3 microns possess the combination of high density (~1.91 grams/cc), high flexural strength (~20,000 psi), high compressive strength (~35,000 psi) and low porosity (~10%). The production of isotropic graphite from coke powders having particle size below 3 micron becomes prohibitively cost—ineffective.

The isotropic graphite produced from coke powders with the particle size of the above stated upper limit i.e. 3 microns possess the combination of lower density (~1.65 grams/cc), lower flexural strength (~5,500 psi), lower compressive strength (~12,000 psi) and higher porosity (~15%). Isotropic graphite produced from coke powders having particle size above 40 micron does not possess attractive enough properties that are justified by the high cost of production process.

Extruded anisotropic graphite is synthesized according to the following steps;

(1) Coarse grain coke (pulverized and purified) is mixed with pitch and warm extruded into green compacts.

(2) The green compacts are baked at 1200° C. (carbonization and densification). The binder (pitch is carbonized)

(3) The baked compact is graphitized into products that are highly porous and structurally weak. It is impregnated with pitch to fill the pores and improve the strength.

(4) The impregnated graphite is baked again at 1200 C. to carbonize the pitch (5) The final product (extruded graphite) contains ~90–95% graphite and ~5–10% loosely bonded carbon.

The typical physical properties of isotropic made via isostatic pressing and anisotropic graphite made via extrusion graphite are given in Tables 1 and 2.

TABLE 1

(PROPERTIES OF ISOTROPIC GRAPHITE MADE VIA ISOSTATIC PRESSING)

| Grade | Density (gm/cc) | Shore Hardness | Flexural Strength (psi) | Comp. Strength (psi) | Grain Size (microns) | Thermal Cond. BTU/ft-hr-° F. | Porosity (open) |
|---|---|---|---|---|---|---|---|
| R8500 | 1.77 | 65 | 7250 | 17400 | 6 | 46 | 13% |
| R8650 | 1.84 | 75 | 9400 | 21750 | 5 | 52 | 12% |
| R8710 | 1.88 | 80 | 12300 | 34800 | 3 | 58 | 10% |

TABLE 2

(PROPERTIES OF ANISOTROPIC GRAPHITE MADE VIA EXTRUSION)

| Grade | Density (gm/cc) | Rockwell "R" Hardness | Flexural Strength (psi) | Comp. Strength (psi) | Grain Size (microns) | Thermal Cond. BTU/ft-hr-° F. | Porosity (open) |
|---|---|---|---|---|---|---|---|
| HLM | 1.72 | 87 | 3500 | 7500 | 410 | 86 | 23% |
| HLR | 1.64 | 58 | 1750 | 4500 | 760 | 85 | 27% |

In Tables 1 and 2, "Comp. Strength" stands for "Compressive Strength" and "Thermal Cond." stands for "Thermal Conductivity".

Graphite produced by isostatic pressing or vibration molding has fine isotropic grains (3–40 microns) whereas graphite produced via extrusion from relative coarse carbon particles have into coarse anisotropic grains (400–1200 microns).

Isotropic graphite has much higher strength, structural integrity than extruded anisotropic graphite due to absence of "loosely bonded" carbon particles, finer grains, higher density and lower porosity.

Extruded graphite has higher thermal conductivity due to anisotropic grain structure formed during extrusion.

When liquid metal is poured into the extruded graphite molds, the mold wall/melt interface is subjected to shear and compressive stresses which cause fracture of graphite at the interface. The graphite particles and "loosely bonded carbon mass" plucked away from the mold wall are absorbed into the hot melt and begin to react with oxide particles in the melt and generate carbon dioxide gas bubbles. These gas bubbles coalesce and get trapped as porosity into the solidified castings.

Due to high intrinsic strength and absence of "loosely bonded" carbon mass, isotropic graphite will resist erosion and fracture due to shearing action of the liquid metal better than extruded graphite and hence castings made in isotropic graphite molds show less casting defects and porosity compared to the castings made in extruded graphite.

Another premium grade of graphite suitable for use as permanent molds for casting various superalloys, titanium and titanium aluminide alloys with high quality is a copper impregnated "isostatic" graphite, R8650C from SGL Graphite Company. It has excellent density, microfine grain size and can be machined/ground to an extremely smooth finish.

Furthermore, according to the present invention, isotropic graphite molds can be coated with a highly wear resistant coating of SiC (silicon carbide) using a chemical vapor deposition (CVD) process. Such CVD coated graphite molds will increase the mold life and significantly enhance the quality of the castings made in the said molds. For example, the SiC may coat at least the portion of the mold defining the cavity of the mold.

B. Alloys

There are a variety of superalloys.

Nickel base superalloys contain 10–20% Cr, up to about 8% Al and/or Ti, and one or more elements in small amounts (0.1–12% total) such as B, C and/or Zr, as well as small amounts (0.1–12% total) of one or more alloying elements such as Mo, Nb, W, Ta, Co, Re, Hf, and Fe. There may also several trace elements such as Mn, Si, P, S, O and N that must be controlled through good melting practices. There may also be inevitable impurity elements, wherein the impurity elements are less than 0.05% each and less than 0.15% total. Unless otherwise specified, all % compositions in the present description are weight percents.

Cobalt base superalloys are less complex than nickel base superalloys and typically contain 10–30% Cr, 5–25% Ni and 2–15% W and small amounts (0.1–12% total) of one or more other elements such as Al, Ti, Nb, Mo, Fe, C, Hf, Ta, and Zr. There may also be inevitable impurity elements, wherein the impurity elements are less than 0.05% each and less than 0.15% total.

Nickel-iron base superalloys contain 25–45% Ni, 37–64% Fe, 10–15% Cr, 0.5–3% Al and/or Ti, and small amounts (0.1–12% total) of one or more elements such as B, C, Mo, Nb, and W. There may also be inevitable impurity elements, wherein the impurity elements are less than 0.05% each and less than 0.15% total.

The invention is also advantageous for use with stainless steel alloys based on Fe primarily containing 10–30% Cr and 5–25% Ni, and small amounts (0.1–12% ) of one or more other elements such as Mo, Ta, W, Ti, Al, Hf, Zr, Re, C, B and V, etc. and inevitable impurity elements, wherein the impurity elements are less than 0.05% each and less than 0.15% total.

The invention is also advantageous for use with metallic alloys based on titanium. Such alloys generally contain at least about 50% Ti and at least one other element selected from the group consisting of Al, V, Cr, Mo, Sn, Si, Zr, Cu, C, B, Fe and Mo, and inevitable impurity elements, wherein the impurity elements are less than 0.05% each and less than 0.15% total.

Suitable metallic alloys also include alloys based on titanium and aluminum known as titanium aluminides which typically contain 50–85% titanium, 15–36% Al, and at least one other element selected from the group consisting of Cr, Nb, V, Mo, Si and Zr and inevitable impurity elements, wherein the impurity elements are less than 0.05% each and less than 0.15% total.

The invention is also advantageous for use with metallic alloys based on at least 50% zirconium and which contain at least one other element selected from the group consisting of Al, V, Mo, Sn, Si, Ti, Hf, Cu, C, Fe and Mo and inevitable impurity elements, wherein the impurity elements are less than 0.05% each and less than 0.15% total.

The invention is also advantageous for use with metallic alloys based on nickel and aluminum commonly known as nickel aluminides. These alloys contain at least 50% nickel, 20–40% Al and optionally at least one other element selected from the group consisting of V, Si, Zr, Cu, C, Fe and Mo and inevitable impurity elements, wherein the impurity elements are less than 0.05% each and less than 0.15% total.

C. Use of the Mold

An alloy is melted by any conventional process that achieves uniform melting and does not oxidize or otherwise harm the alloy. For example, a preferred heating method is vacuum induction melting. Vacuum induction melting is a known alloy melting process as described in the following references incorporated herein by reference:

D. P. Moon et al, ASTM Data Series DS 7-SI, 1–350 (1953)

M. C. Hebeisen et al, NASA SP-5095, 31-42 (1971)

R. Schlatter, "Vacuum Induction Melting Technology of High Temperature Alloys" Proceedings of the AIME Electric Furnace Conference, Toronto (1971).

Examples of other suitable heating processes include "plasma vacuum arc remelting" technique and induction skull melting.

Preferably the molds are kept heated (200–800° C.) in the mold chamber of the vacuum furnace prior to the casting of melt in the molds. This heating is particularly important for casing complex shapes. The molds can be also kept at ambient temperatures for casting simple shapes. Typical preferred ranges for keeping the molds heated are between 150 and 800° C., between 200 and 800° C., between 150 and 450° C., and between 250 and 450° C.

The candidate iron, nickel and cobalt base superalloys are melted in vacuum by an induction melting technique and the liquid metal is poured under full or partial vacuum into the heated or unheated graphite mold. In some instances of partial vacuum, the liquid metal is poured under a partial pressure of inert gas. The molding then occurs under full or partial vacuum.

The high strength graphite mold with high thermal conductivity allows fast cooling of melt that is poured into it. High purity and high density of the mold material enhances non-reactivity of the mold surface with respect to the liquid melt during fast solidification. As a consequence, the process of the present invention produces a casting having a very smooth high quality surface as compared to the conventional ceramic mold investment casting process. The isotropic graphite molds show very little reaction with molten superalloys and suffer minimal wear and erosion after use and hence, can be used repeatedly over many times to fabricate castings of superalloys with high quality. Whereas the conventional investment casting molds are used one time for fabrication of superalloy, stainless steel, titanium and titanium aluminide alloy castings. The present invention is particularly suitable for fabricating highly alloyed nickel, cobalt and iron base superalloys, titanium alloys and titanium aluminide alloys which are difficult to fabricate by other processes such as forging or machining. Such alloys can be fabricated in accordance with the present invention as near net shaped or net shaped components thereby minimizing subsequent machining operations.

Furthermore, the fine grain structures of the castings resulting from the fast cooling rates experienced by the melt will lead to improved mechanical properties such as high tensile strength and superior low cycle fatigue strength.

According to the present invention, titanium alloys and titanium alloys are induction melted in a water cooled copper crucible or yttrium oxide crucible and are cast in high density, high strength ultrafine grained isotropic graphite molds heated in-situ at temperatures between 150° C. and 800° C. Furthermore, titanium alloys can be melted in water-cooled copper crucible via the "plasma vacuum arc remelting" technique. The castings are produced with high quality surface and dimensional tolerances free from casting defects and contamination. Use of the casting process according to the present invention eliminates the necessity of chemical milling to clean the contaminated surface layer on the casting as commonly present in titanium castings produced by the conventional investment casting method. Since the isotropic graphite molds do not react with the titanium melt and show no sign of erosion and damage, the molds can be used repeatedly numerous times to lower the cost of production.

Superalloys, titanium alloys and titanium aluminide alloys, zirconium alloys and nickel aluminide alloys fabricated as castings by the process as described in the present invention will find applications as jet engine parts and other high technology components requiring improved performance capabilities.

For example, the present invention may be used to make castings for a wide variety of titanium alloy products. Typical products include titanium alloy products for the aerospace, chemical and energy industries, medical prosthesis, and/or golf club heads. Typical medical prosthesis include surgical implants, for example, plates, pins and artificial joints (for example hip implants or jaw implants). The present invention may also be used to make golf club heads.

VII. Parameters

Compressive strength is measured by ASTM C.

Flexural strength is measured by ASTM C 651.

Ultimate tensile strength is measured according to ASTM E8-00.

0.2% Offset Yield Strength is measured according to ASTM E8-00.

% Elongation is measured according to ASTM E8-00.

% RA (Reduction in area) is measured according to ASTM E8-00.

Rupture life is measured by ASTM E 130.

Thermal conductivity is measured according to ASTM C-714.

Rockwell hardness is measured according to ASTM D 785.

Shore hardness is measured according to ASTM D2240.

Modulus of elasticity is measured according to ASTM E-228.

Porosity is measured according to ASTM C-830.

VIII. EXAMPLES

Example 1

Various nickel, cobalt and iron base superalloys that have been successfully vacuum induction melted and vacuum cast in isotropic graphite molds as round and square bars with high integrity and quality are given in Table 3.

TABLE 3

(compositions are in weight %)

| Alloy | Ni | Cr | Co | Mo | W | Fe | C | Ta + Nb | Al | Ti | Si | Others |
|---|---|---|---|---|---|---|---|---|---|---|---|---|
| IN 738 | 63 | 16 | 8.5 | 1.75 | 2.6 | 0.5 | 0.13 | 2.6 | 3.45 | 3.45 | 0.2 | 0.1 Hf |
| Rene 80 | 60.5 | 14 | 9.5 | 4.0 | 4.0 | 0.17 | | 3.0 | 5.0 | | | 0.03 Zr 0.15B |
| Mar-M247 | 60 | 8.25 | 10 | 0.7 | 10 | | 0.15 | 3.0 | 5.5 | 1.0 | | 1.5Hf 0.15B 0.05Zr |
| PWA 795 | 14.03 | 19.96 | 46.4 | | 9.33 | | 0.35 | 2.89 | 4.4 | 0.18 | 0.17 | 1.14Hf 0.02Zr 0.07Y |
| Rene 142 | 57.4 | 6.89 | 11.90 | 1.47 | 5.03 | | 0.12 | 6.46 | 6.25 | 0.005 | 0.012 | 2.76Re 1.54Hf 0.017 Zr 0.018B |
| Mar-M200 | 59 | 9.0 | 10.0 | | 12.5 | 1.5 | 0.15 | 1.0 | 5.0 | 2.0 | | 0.015B 0.05Zr |
| FSX 414 | 10 | 29 | 53.08 | | 7.0 | | 0.12 | | | | 0.8 | |
| IN 939 | 48.33 | 22.5 | 19 | | 2.0 | | 0.16 | 1.35 | 1.85 | 3.8 | | 0.005B 0.01 Nb |

TABLE 3-continued (compositions are in weight %)

| Alloy | Ni | Cr | Co | Mo | W | Fe | C | Ta + Nb | Al | Ti | Si | Others |
|---|---|---|---|---|---|---|---|---|---|---|---|---|
| IN 792 | 61 | 12.5 | 9.0 | 1.9 | 4.15 | 0.5 | 0.1 | 4.65 | 3.35 | 3.95 | 0.2 | |
| Mar-M918 | 19 | 19 | 54.56 | | | 0.5 | 0.04 | 7.0 Ta | | | | |
| Mar-M509 | 10 | 23.5 | 55 | | 7.0 | | 0.60 | 3.5 | | 0.2 | | 0.5Zr |
| Alloy 1957 | 69.9 | 21.67 | 0.009 | | | | 0.012 | 2.63 | | 0.57 | 0.43 | 1.98Pd |
| PMet 920 | 43.45 | 20 | 13.5 | 1.5 | 15.50 | | 0.045 | 4.2 Ta | 0.80 | | 0.40 | 0.60 Mn |
| Alloy 1896 | 60.23 | 14 | 9.5 | 1.55 | 3.8 | 0.10 | | 2.8 Ta | 3.0 | 4.9 | | 0.035 Zr 0.005 B |
| 501 SS | | 7.0 | | 0.55 | | 92.33 | 0.12 | | | | | |
| SS 316-GD | 11.65 | 16.33 | 2.2 | | 66.65 | | | | | | 0.1 | 0.4Gd 1.7Mn |

Typical shapes of castings fabricated are as follows:

(1) 1 inch diameter×25 inches long (2) ½ inch diameter×25 inches long (3) ¼ inch diameter×25 inches long (4) 4 inches×4 inches×14 inches long (5) 7 inches diameter×20 inches long (6) stylized turbine disc (7) disc with gear teeth (8) disc with fir tree groove along the circumference.

Castings produced in isotropic graphite molds show significantly better quality containing less casting defects than those made in extruded graphite molds.

For example, several of the alloys listed in TABLE 3 such as IN 738, Rene 142, PWA 795 and Pmet 920 when vacuum melted and cast as 1 inch diameter×25 inch long bars in isotropic graphite molds (R 8500) showed excellent surface quality free from casting defects. As cast bars had smooth and shiny surface showing no evidence of interaction between melt and mold surface. The molds also showed no wear and erosion after the cast bars were removed from them. The same molds were found suitable for repeated uses and used more than fifty times to produce bars with reproducible quality. Repeated use of the isotropic graphite molds will reduce significantly the cost of production of the castings.

On the contrary, when the molds were made of extruded anisotropic graphite (i.e., HLM and HLR grades), the quality of the cast bars (1 inch diameter) of the alloys listed in TABLE 3 was found to be poor. The bar surfaces showed evidence of casting defects (surface irregularities, cavities, pits and gas holes). There was evidence of some interaction of the mold surface with the melt causing mold wear. The extruded graphite has low density and, low strength and large amount of porosity compared to the isotropic graphite. Consequently, the machined surfaces of the extruded graphite molds are less smooth and the castings made in such molds tend to exhibit inferior surface quality compared to those made in isotropic graphite molds. Furthermore, due to rapid erosion of mold surface in contact with molten metal during the casting process, the extruded mold deteriorates so much after it is used a few times, i.e. 2 or 3 times, that the quality of castings becomes unacceptable.

The isotropic graphite is produced in different grades as listed in TABLE 2. Graphite with higher density, higher strength and smaller grain size produce better quality castings. In the present investigation, the based on the experiments with different grades of graphite molds, the best quality castings were produced with R8710 graphite mold.

Example 2

Experiments with Heated Molds

Several experiments were made with isotropic graphite molds heated above ambient temperature in the vacuum chamber prior to pouring the molten alloy in the molds. The molds heated to temperatures between 150° C. and 800° C. are best suited to produce castings with excellent surface quality and integrity. When the mold is kept unheated (i.e., at room temperature), during gravity filling of the mold, the molten alloy may produce splatters/droplets upon impact with the mold surface which may quickly freeze in contact with the cold mold walls. The prematurely solidified splatters/droplets get embedded on the casting surface and appear as casting defects. When the mold is heated, the mold can be filled up with melt prior to the start of solidification. The splatters formed during filling do not stick to the heated mold walls and once the entire mold is filled up, then only the solidification of the melt begins. The casting surface obtained with the heated molds appears to be very smooth free from casting defects.

If the molds are heated above 800° C., there is a tendency for the melt to react with graphite. As a result, the castings may pick up additional carbon that is detrimental to the properties of the castings. The mold-melt reaction also leads to rapid deterioration of the graphite mold surface and as a consequence, the mold can not be used repeatedly.

Preferably the mold should be heated to between 250° C. and 450° C.

Example 3

Castings of Shapes

Several split molds were made from R8500 isotropic graphite blocks used to make castings of different shapes.

Figure 1:
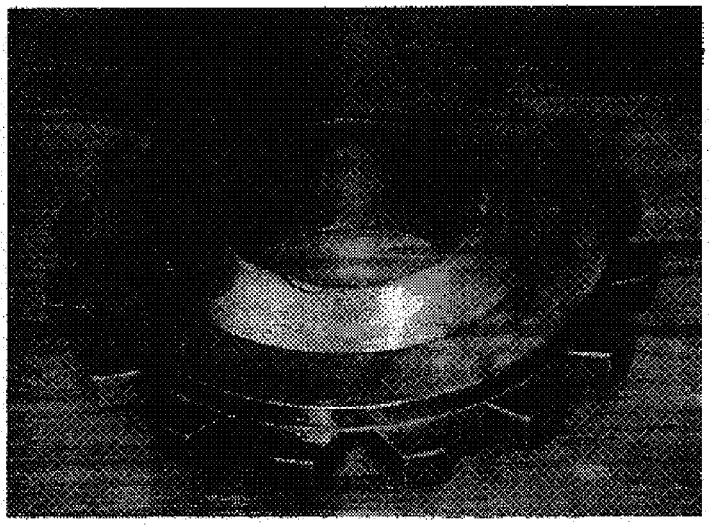
FIG. 1 shows a photograph of a casting of a Mar-M-247 gear cast in an isotropic fine grained graphite mold.
Figure 2:
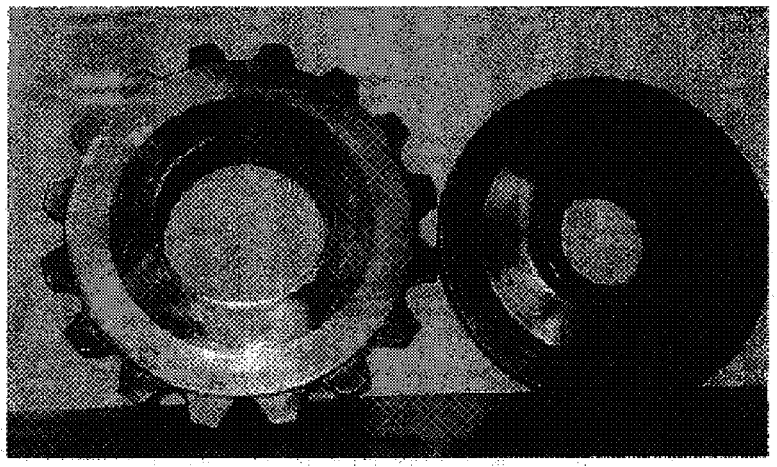
FIG. 2 shows a photograph of a Mar-M-247 gear (having teeth) and a Mar-M-247 stylized disc cast in an Isotropic Graphite Mold.
Figure 3:
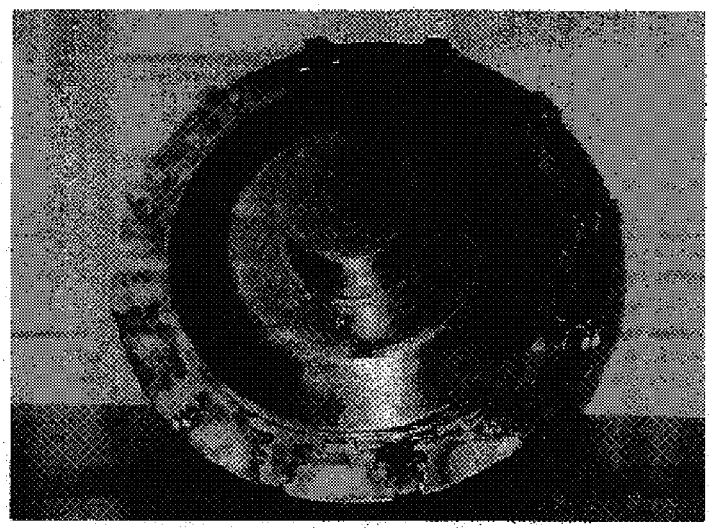
FIG. 3 shows a photograph of a casting of a Mar-M-247 disc with fir tree slots cast in an isotropic fine grained graphite mold.
Figure 4:
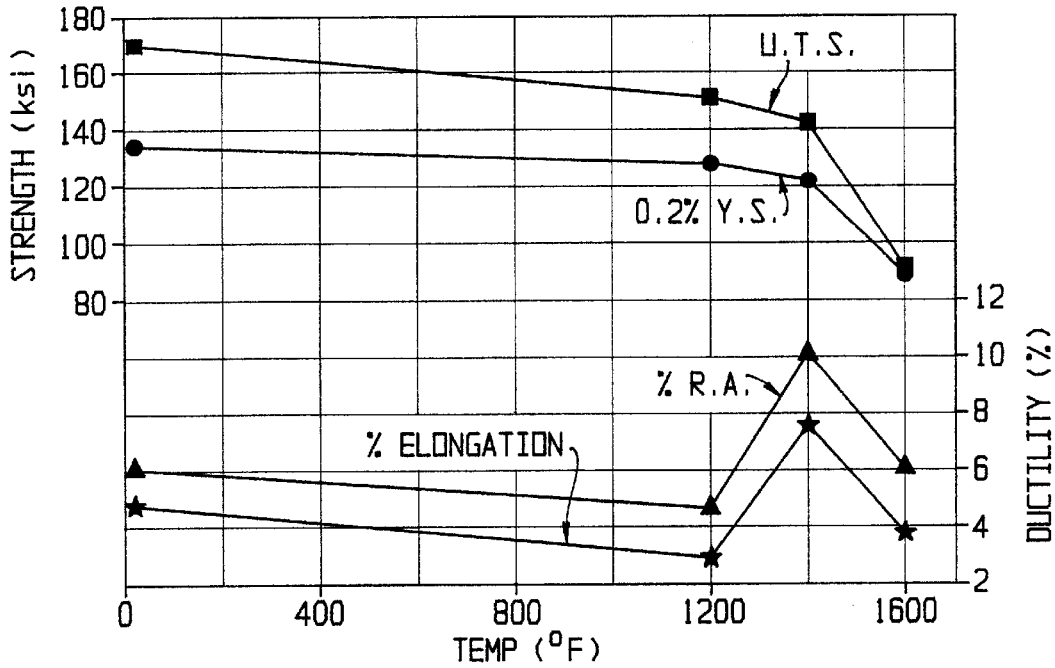
FIG. 4 shows the plot of tensile properties as a function of temperatures of alloy IN 939 for a 1 inch diameter bar cast in a graphite mold—hot isostatic pressed (HIP) and heat treated.
Figure 5:
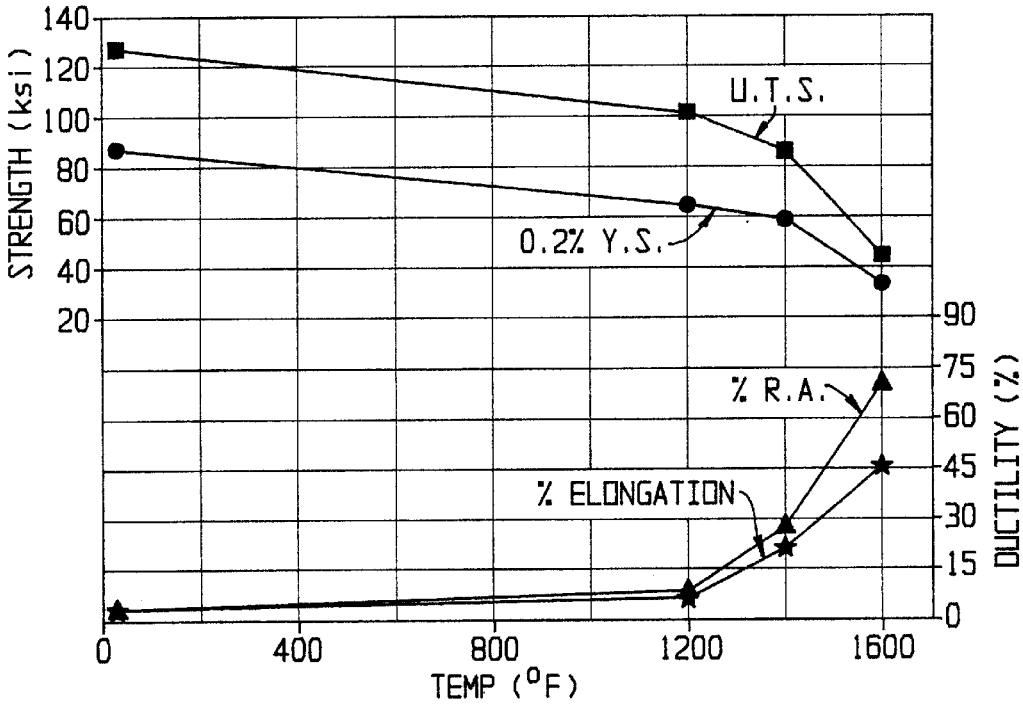
FIG. 5 shows the plot of tensile properties as a function of temperatures of alloy PWA 795 for a 1 inch diameter bar cast in a graphite mold—hot isostatic pressed.
Figure 6:
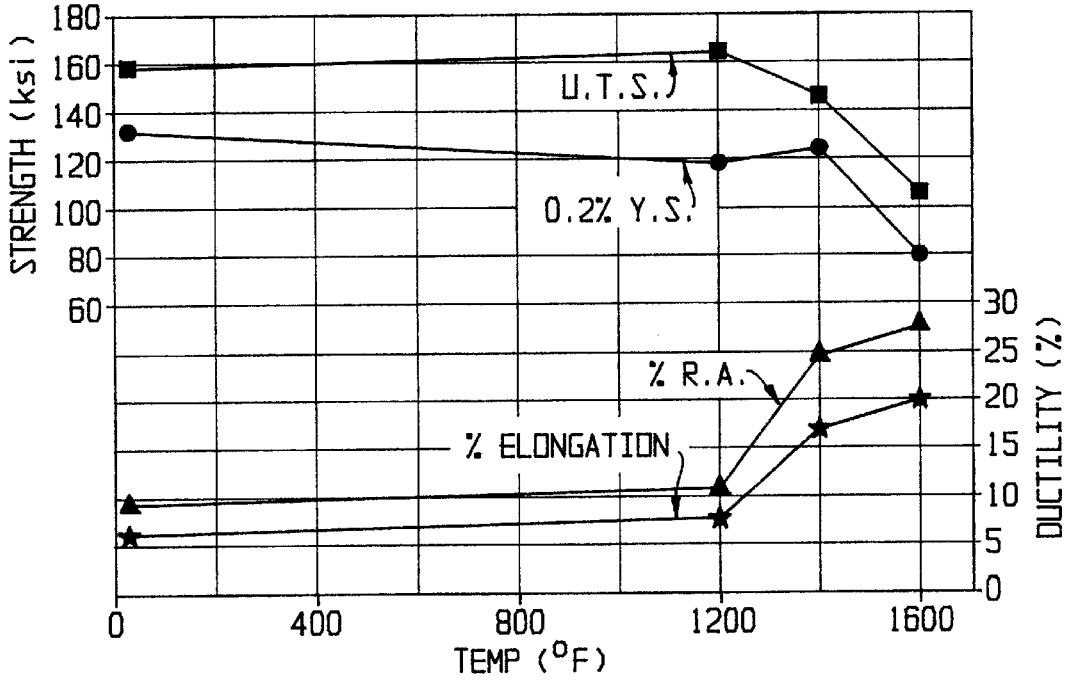
FIG. 6 shows the plot of tensile properties as a function of temperatures of alloy IN 738 for a 1 inch diameter bar cast in a graphite mold—hot isostatic pressed and heat treated.
Figure 7:
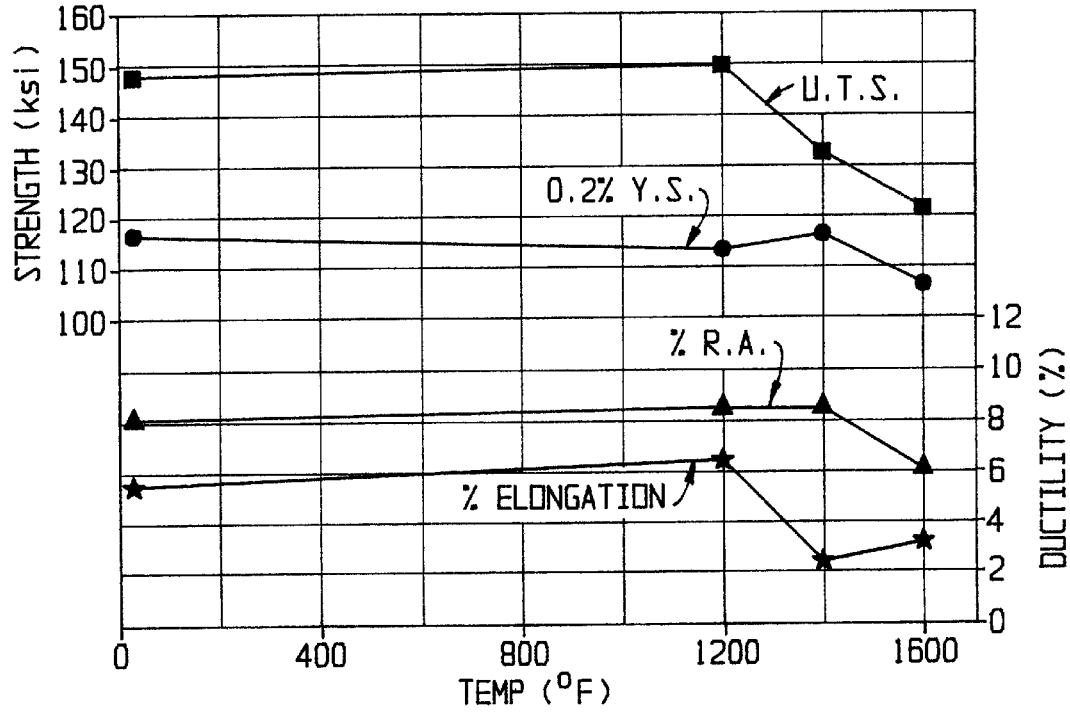
FIG. 7 shows the plot of tensile properties as a function of temperatures of alloy Rene 142 for a 1 inch diameter bar cast in a graphite mold—hot isostatic pressed and heat treated.

The alloy Mar-M-247 (a nickel base superalloy) was vacuum melted and successfully cast in the molds producing sound high quality castings. Typical shapes produced were: a stylized turbine disc, a disc with gear teeth and a disc with fir-tree slots. The castings typically weighed 25 to 35 lbs. each. After each casting was made, the mold showed no wear and tear or reaction with the melt. The mold was evaluated to be suitable for repeated production of similar castings with consistent and reproducible quality. FIGS. 1, 2 and 3 show the examples of typical castings of different shapes made with Mar-M-247 alloy using an isotropic graphite mold in accordance with the present invention.

The stylized disc casting of Mar-M-247 alloy was cut into several sections. Tensile and stress rupture test specimens were prepared from round bars obtained from these sections after heat treatment at 870° C. for 16 hours.

The test bars were taken with tensile axis parallel to the tangential direction as well as radial direction of the disc.

The tensile and stress rupture test bars were prepared with 0.25 inch gage diameter according the specifications of ASTM E8-00.

The results of tensile and stress rupture tests are given in the following Tables 4, 5 and 6.

TABLE 4

(Room and elevated temperature tensile tests)

| Alloy and heat treatment | Tensile axis parallel to | Test Temperature (° F.) | Ultimate Tensile Strength (psi) | 0.2% Offset Yield strength (psi) | % Elongation | % RA |
|---|---|---|---|---|---|---|
| Mar-M-247 Aged at 870 ° C. for 16 hours followed by air cooling to room temperature | Radial axis of the disc | Room | 143,000 | 136.000 | 6.5 | 9.0 |
| Mar-M-247 Aged at 870 ° C. for 16 hours followed by air cooling to room temperature | Radial axis of the disc | 1000 | 143,900 | 142,000 | 3.0 | 4.0 |
| Mar-M-247 Aged at 870 ° C. for 16 hours followed by air cooling to room temperature | Radial axis of the disc | 1200 | 156,000 | 144,700 | 7.0 | 15.5 |
| Mar-M-247 Aged at 870 ° C. for 16 hours followed by air cooling to room temperature | Radial axis of the disc | 1400 | 156,400 | 143,200 | 8.0 | 9.4 |
| Mar-M-247 Aged at 870 ° C. for 16 hours followed by air cooling to room temperature | Radial axis of the disc | 1600 | 147,800 | 133,500 | 6.0 | 7.1 |

TABLE 5

(Room and elevated temperature tensile tests)

| Alloy and heat treatment | Tensile axis parallel to | Test Temperature (° F.) | Ultimate Tensile Strength (psi) | 0.2% Offset Yield strength (psi) | % Elongation | % RA |
|---|---|---|---|---|---|---|
| Mar-M-247 Aged at 870 ° C. for 16 hours followed by air cooling to room temperature | The tangent to the circumference of the disc | Room | 141,000 | 131,000 | 6.0 | 6.0 |
| Mar-M-247 Aged at 870 ° C. for 16 hours followed by air cooling to room temperature | The tangent to the circumference of the disc | 1000 | 139,500 | 131,400 | 7.0 | 12.0 |
| Mar-M-247 Aged at 870 ° C. for 16 hours followed by air cooling to room temperature | The tangent to the circumference of the disc | 1200 | 145,200 | 134,900 | 7.0 | 15.0 |
| Mar-M-247 Aged at 870 ° C. for 16 hours followed by air cooling to room temperature | The tangent to the circumference of the disc | 1400 | 161,200 | 141,200 | 7.5 | 12.0 |
| Mar-M-247 Aged at 870 ° C. for 16 hours followed by air cooling to room temperature | The tangent to the circumference of the disc | 1600 | 141.000 | 123,700 | 9.0 | 20.0 |

TABLE 6

(Stress Rupture Tests)

| Alloy and heat treatment condition | Tensile axis parallel to | Test Temperature (° F.) | Stress (psi) | Rupture Life (hours) |
|---|---|---|---|---|
| Mar-M-247 Aged at 870° C. for 16 hours followed by air cooling to room temperature | Radial axis of the disc | 1600 | 60,000 | 79.6 |
| Mar-M-247 Aged at 870° C. for 16 hours followed by air cooling to room temperature | Radial axis of the disc | 1500 | 75,000 | 416 |

Several nickel and cobalt base alloys were induction melted in vacuum and cast into isotropic graphite molds of the grade R8500 as 1 inch diameter bars. The bars were heat treated and subsequently tested for tensile properties at room and elevated temperatures. The tensile test bars were prepared with 0.25 inch gage diameter according the specifications of ASTM E8-00.

The results are listed in TABLE 7.

TABLE 7

(room and elevated temperature tensile properties)

| Alloy | Heat treatment | Test temperature (° F.) | Ultimate tensile strength (psi) | 0.2% Yield Strength (psi) |
|---|---|---|---|---|
| IN738 | solution heat | Room | 131,000 | 128,000 |
| | treated at 1120° C./ | 1200 | 120,000 | 107,000 |
| | 2 hours, annealed at | 1400 | 135,000 | 116,000 |
| | 845° C./24 hours | 1600 | 101,000 | 72,000 |
| PMET | solution heat treated | Room | 84,500 | 66,000 |
| 920 | at 1120° C./2 hours, | 1200 | 73,500 | 51,000 |
| | annealed at 850° C./ | 1400 | 72,000 | 52,500 |
| | 16 hours | 1600 | 55,000 | 40,300 |
| IN939 | solution heat treated | Room | 145,000 | 137,000 |
| | at 1160° C./4 hours, | 1200 | 129,000 | 121,000 |
| | annealed at 850° C./ | 1400 | 135,000 | 118,000 |
| | 16 hours | 1600 | 84,500 | 76,000 |
| PWA | as cast condition | Room | 102,000 | 69,000 |
| 795 | | 1200 | 87,000 | 50,500 |
| | | 1400 | 84,500 | 55,500 |
| | | 1600 | 43,200 | 32,320 |

Note:
IN 738, PMET920 and IN939 are nickel base alloys.
PWA 795 is a cobalt base alloy.

FIGS. 4, 5, 6 and 7 tensile properties as a function of temperatures of alloys IN 939, PWA 795, IN 738, and Rene142. The compositions of these alloys are given in Table 3.

Figure 8:
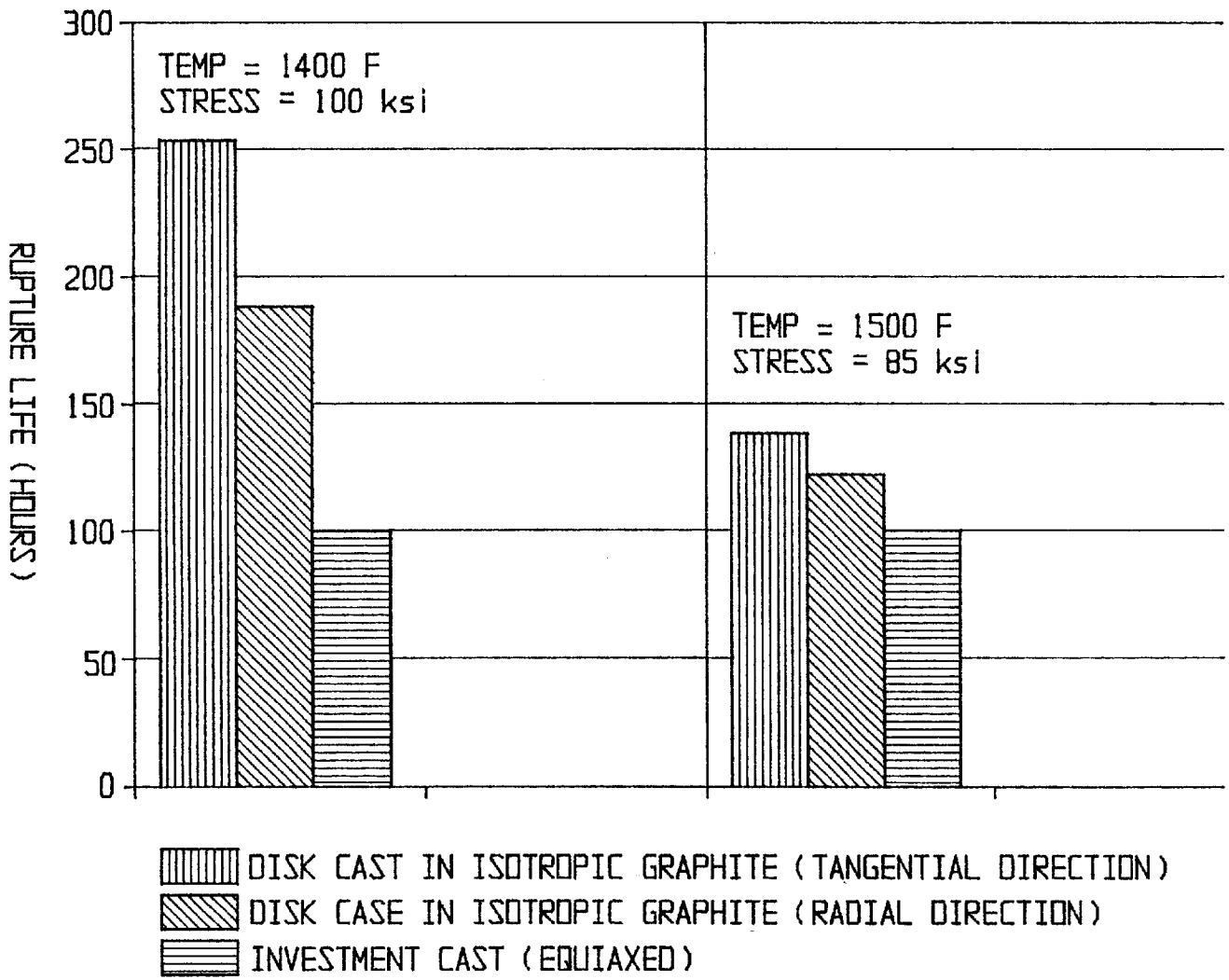
FIG. 8 shows stress rupture properties of Mar-M-247. The time to failure of the specimen subjected to constant stress at elevated temperatures is determined as stress rupture life.
Figure 9A:
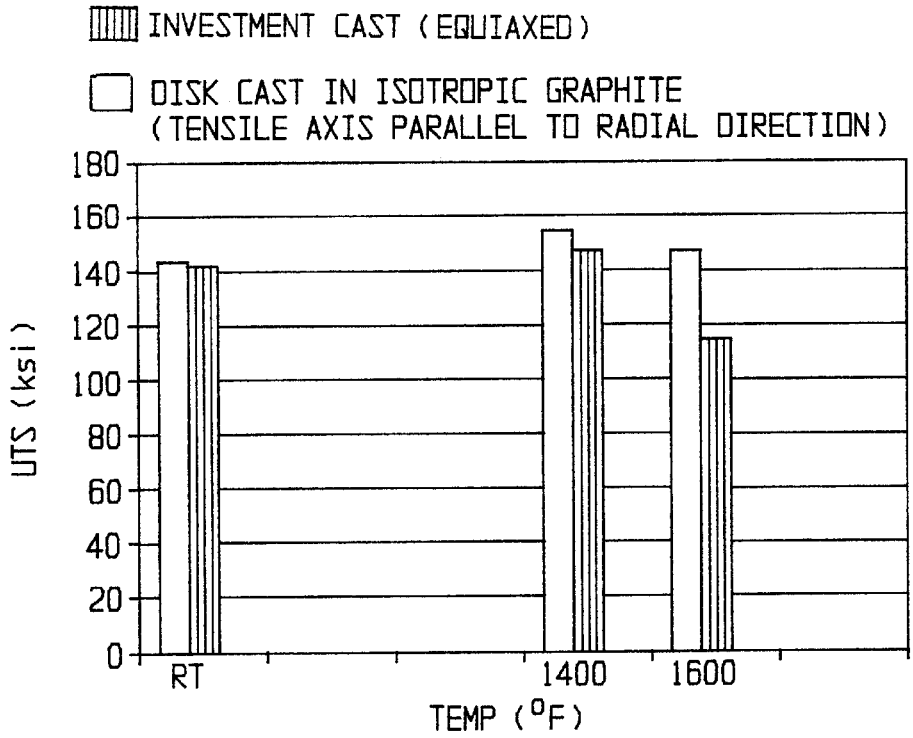
FIGS. 9A–9D show a comparison of properties of Mar-M-247 alloy cast by an investment casting process with those of Mar-M-247 cast in isotropic fine grained graphite mold as bar chart plots of tensile strength (UTS) and 0.2% yield strength.
Figure 9B:
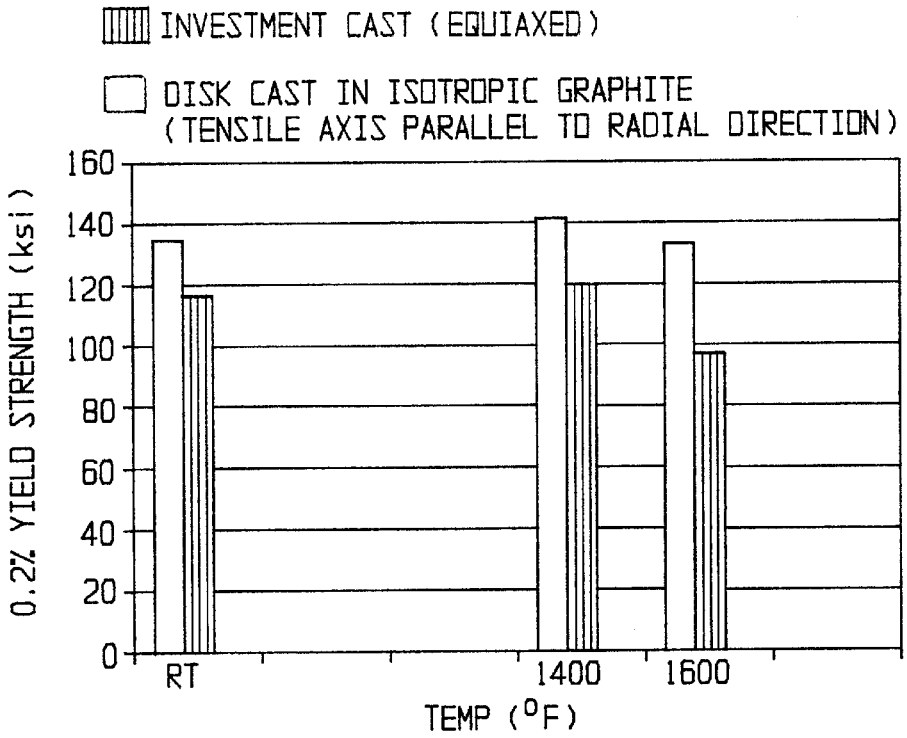
Figure 9C:
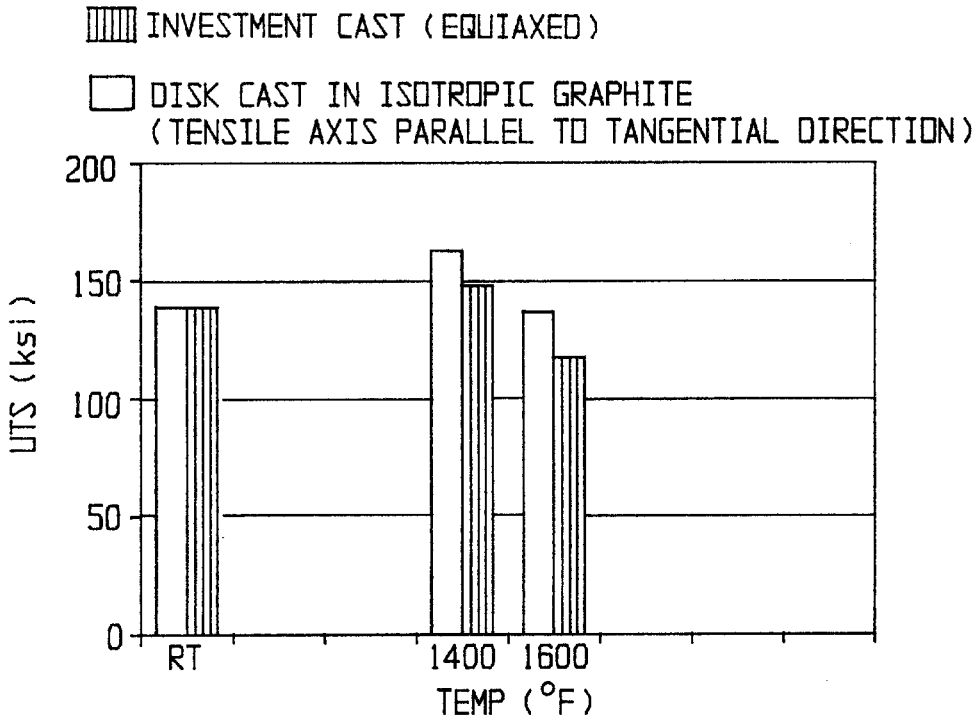
Figure 9D:
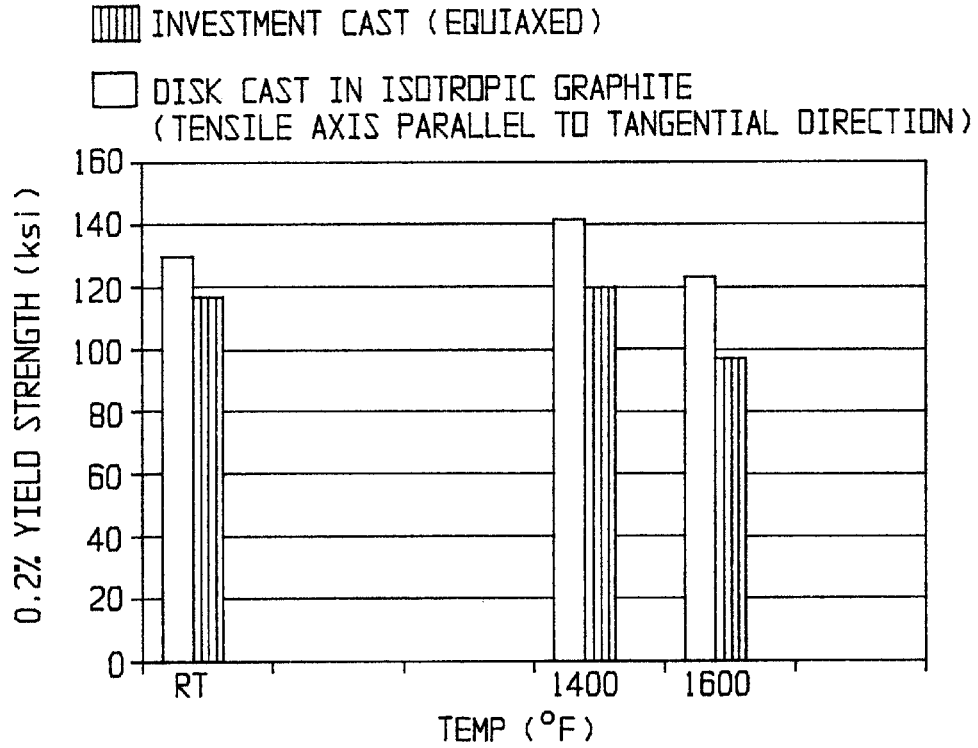

FIG. 8 shows the comparison of stress rupture properties of Mar-M-247 alloy made by investment casting process with those of Mar-M-247 disc cast in isotropic fine grained graphite mold. The stress rupture test were prepared with 0.25 inch gage diameter according the specifications of ASTM E8-00.

FIGS. 9A, 9B, 9C, and 9D show the bar chart plots of ultimate tensile strength (UTS) and 0.2% yield strength of test bars taken along radial and tangential directions from a Mar-M-247 stylized disc cast in isotropic fine-grained graphite mold. In the same plots, the tensile properties of Mar-M-247 investment cast alloy with equiaxed grains are shown as comparison. The tensile test bars were prepared with 0.25 inch gage diameter according to the specifications of ASTM E8-00. The data reveals that at elevated temperatures (i.e. 1400–1600° F.), the tensile properties of Mar-M-247 disc cast in isotropic graphite mold are superior to those of investment cast, equiaxed Mar-M-247 alloy.

Example 4

Mold Metal Interaction

Selected nickel, cobalt and iron base superalloys that have been successfully vacuum induction melted and vacuum cast in isotropic graphite molds as round and square bars with high integrity and quality as given in Table 3 were metallographically examined for any evidence of reaction of the melt with graphite mold.

Samples from alloys Mar-M-247, Mar-M-509, IN 738 and IN 792 (see Table 3 for compositions) were metallographically polished and etched. The microstructures of the samples in the bulk are and near the mold-melt interface were investigated by scanning electron microscopy. It was observed that the microstructures of the bulk area and near the mold-melt interface are identical as shown in FIGS. 10A, 10B, 11A, 11B, 12A, 12B, 13A and 13B.

FIGS. 10A and 10B, respectively, show SEM pictures of Mar-M-247 (as cast) cast in isotropic graphite mold to show the microstructure of a bulk area and microstructure near the mold-melt interface.

FIGS. 11A and 11B, respectively, show SEM pictures of Mar-M-509 (as cast) cast in isotropic graphite mold to show the microstructure of a bulk area and microstructure near the mold-melt interface.

FIGS. 12A and 12B, respectively, show SEM pictures of IN 738 (as cast) cast in isotropic graphite mold to show the microstructure of a bulk area and microstructure near the mold-melt interface.

FIGS. 13A and 13B, respectively, show SEM pictures of IN 792 (as cast) cast in isotropic graphite mold to show the microstructure of a bulk area and microstructure near the mold-melt interface.

These results demonstrate that there is no reaction between the molten nickel, cobalt and iron base alloys with isotropic fine grained graphite mold.

Example 5

Mold Metal Interaction

Alloy IN 939 (see Table 3 for composition) was successfully vacuum induction melted and vacuum cast as round bars having 1 inch diameter in graphite molds of three different grades as follows: R 8500, R 8710 and HLM.

R 8500 and R 8710 are isotropic grade graphite having properties in accordance with the scope of the present invention as listed in Table 1. HLM is a graphite made by extrusion having the properties outside the scope of the present invention as listed in Table 2.

Carbon concentration in the cast round bars was analyzed from the outer surface to 30 microns depth inside using Secondary Ion Mass Spectrometry (SIMS) technique.

Carbon concentration profile as a function of depth was shown in FIG. 14. Data from the top 3 microns of the specimens are not valid due to the combination of the dynamic SIMS surface transient and the input from surface contamination.

From the data shown in FIG. 14, it is clearly evident that the carbon concentration from surface towards the inside of the samples cast in isotropic graphite molds (R 8710 and R 8500) did not change. This indicates there was no reaction between the molten alloy and isotropic graphite molds in accordance with the scope of the present invention.

In contrast, the carbon concentration profile as a function of depth in the sample taken from the bar cast in extruded graphite mold (HLM grade) showed gradual increase as the depth decreases towards the surface. This indicates carbon pick from the extruded graphite mold by the molten alloy.

Example 6

Titanium and Titanium Aluminide Castings

Titanium alloys and titanium alloys were induction melted in a water cooled copper crucible or yttrium crucible and cast in high density isotropic graphite molds heated in-situ at temperatures between 150° C. and 800° C.

The castings were produced with high quality surface and dimensional tolerances free from casting defects and contamination. Use of the casting process according to the present invention eliminates the necessity of chemical milling to clean the contaminated surface layer on the casting as commonly present in titanium castings produced by the conventional investment casting method. Since the isotropic graphite molds did not react with the titanium melt and show no sign of erosion and damage, the molds can be used repeatedly numerous times to lower the cost of production.

Tables 8 and 9 list several titanium and titanium aluminide alloys that are processed into castings of high quality in isotropic graphite molds in accordance with the present invention.

TABLE 8

(Titanium alloys)

| Alloy | Composition (wt %) | | | | | | | | | |
|---|---|---|---|---|---|---|---|---|---|---|
| No. | Ti | Al | V | Sn | Fe | Cu | C | Zr | Mo | Other |
| 1 | Bal | 6.0 | 5.05 | 2.15 | 0.60 | 0.55 | 0.03 | | | |
| 2 | Bal | 3.0 | 10.3 | 2.1 | | | 0.05 | | | |
| 3 | Bal | 5.5 | | 2.1 | | | | 3.7 | 0.3 | |
| 4 | Bal | 6.2 | | 2.0 | | | | 4.0 | 6.0 | |
| 5 | Bal | 6.2 | | 2.0 | | | | 2.0 | 2.0 | 2.0 Cr 0.25 Si |
| 6 | Bal | 5.0 | | 2.25 | | | | | | |
| 7 | Bal | 2.5 | 13 | 7.0 | | | | 2.0 | | |
| 8 | Bal | 3.0 | 10 | | 2 | | | | | |
| 9 | Bal | 3 | 15 | 3 | | | | | | 3.0 Cr |
| 10 | Bal | | | 4.5 | | | | 6 | 11.5 | |

TABLE 9

(Titanium aluminum alloys)

| Alloy No. | Composition (wt %) | | | | |
|---|---|---|---|---|---|
| | Ti | Al | Nb | V | Other |
| 1 | Bal | 14 | 21 | | |
| 2 | Bal | 18 | 3 | 2.7 | |
| 3 | Bal | 31 | 7 | 1.8 | 2.0 Mo |
| 4 | Bal | 24 | 15 | | |
| 5 | Bal | 26 | 12 | | |
| 6 | Bal | 25 | 10 | 3.0 | 1.5 Mo |

Example 7

Titanium Alloy Casting

A titanium alloy having the composition of Ti-6Al-4V (wt %) was induction melted in a water cooled crucible and cast into step plates in isotropic fine grained graphite mold under vacuum.

The dimensions of the step plates are: 7 inch wide×20 inch long with multiple step ranging from 2 inch thickness to ⅛ inch. FIG. 15 shows the Ti-6Al-4V titanium step plate casting made using isotropic graphite molds.

FIG. 16 shows the macro etched structure of the Ti-6Al-4V step plate casting.

FIGS. 17A and 17B, respectively, show the microstructure of the bulk area from the Ti6Al-4V step plate castings with 1 inch and 0.75 inch thicknesses. The microstructures of the castings are very uniform and homogeneous consisting of equiaxed transformed beta grains. The grain size decreases with decreasing thickness of the castings.

FIGS. 18A and 18B, respectively, show the typical microstructures of the Ti-6Al-4V step plate castings, with 1 inch and 0.75 inch thicknesses, near the edges. As evident from the microstructures, there is no alpha casing near the edge indicating lack of reaction between the titanium melt and graphite mold.

Example 8

Tensile Properties of Titanium Alloy Casting

The titanium step plate castings of Example 7 were hot isostatically pressed at 1600° F. for 4 hours and then tested for various mechanical properties.

Table 10 lists the room temperature tensile properties of specimens with 0.25 inch gage diameter taken from 0.5 inch thick Ti-6Al-4V casting made in isotropic graphite mold in accordance with the present invention. The tensile test bars were prepared with 0.25 inch gage diameter according the specifications of ASTM E8-00. The data based on 10 test samples show is very uniform with very little scatter indicating a very homogeneous microstructure of the casting.

TABLE 10

Room Temperature Tensile Properties of 0.5 inch thick Ti-6Al-4V casting made in isotropic graphite mold

| Specimen | UTS (KSI) | 0.2% YS(KSI) | % EL | % RA |
|---|---|---|---|---|
| 1 | 134 | 120 | 10 | 18 |
| 2 | 135 | 123 | 8 | 20 |
| 3 | 134 | 122 | 9 | 17 |
| 4 | 135 | 122 | 10 | 20 |
| 5 | 135 | 124 | 9 | 21 |
| 6 | 135 | 122 | 12 | 20 |
| 7 | 134 | 122 | 10 | 18 |
| 8 | 135 | 122 | 12 | 20 |
| 9 | 134 | 122 | 9 | 18 |
| 10 | 135 | 123 | 9 | 18 |

Table 11 lists the room temperature tensile properties of test specimens with 0.385 inch gage diameter obtained from 1 inch thick Ti-6Al-4V casting made in accordance with the scope of the present invention. The tests were made in accordance with ASTM E8-00 specifications.

TABLE 11

Room Temperature Tensile Properties of 1.0 inch thick Ti-6Al-4V casting made in isotropic graphite mold

| Specimen | UTS (KSI) | 0.2% YS (KSI) | % EL | % RA |
|---|---|---|---|---|
| 1 | 134 | 121 | 6.5 | 12 |
| 2 | 132 | 119 | 7 | 15 |
| 3 | 132 | 118 | 7 | 17 |

Example 9

Cyclic Stress Strain Fatigue Properties of Titanium Alloy Casting

Cyclic stress strain fatigue test specimen was machined from a Ti-6Al-4V plate casting in example 7. FIG. 26 shows a sketch of the cyclic stress strain fatigue test specimen. The specimen was tested at room temperature using a triangular waveform at six cycles per minute. The specimen was tested at a maximum strain of 1.5%. The strain was reduced by 1/20 of the maximum strain for twenty steps. Then the strain was increased by 1/20 of the maximum strain for twenty steps. This procedure was repeated until the specimen failed. The cyclic yield strength was determined from the test and listed in Table 12 below.

TABLE 12

Cyclic Stress Strain Fatigue properties of Ti-6Al-4V Plate Casting

| Temp | Maximum Strain | Number of Steps | Cyclic Yield Strength (KSI) | Cycle to Failure |
|---|---|---|---|---|
| Room | 1.5 | 20 | 121 | 250 |

Example 10

Low Cycle Fatigue Properties of Titanium Alloy Casting

Low cycle fatigue tests were carried out on specimens obtained from Ti-6Al-4V plate casting of Example 7 according to ASTM E 606-92 (1998). FIG. 27A shows a sketch of the low cycle fatigue test specimen 100. FIG. 27B shows a sketch of an enlarged portion 110 of the test specimen 100 of FIG. 27A. The specimens were tested at room temperature using a triangular waveform at a frequency of 30 cycles per minute with an R Ratio of −1.0. Specimens reaching 43200 cycles (24 hours) with no plasticity were switched to load control at a frequency of 10 Hz. Failure was defined as the point where the maximum stress decreased to 50% of the maximum stress of the $100^{th}$ cycle.

The results are plotted in FIG. 19.

Example 11

Fatigue Crack Growth Rate Properties of Titanium Alloy Casting

One compact tension specimen was machined from Ti-6Al-4V plate casting of Example 7. The specimen was pre-cracked, and fatigue crack growth rate (FCGR) tested according to the procedures of ASTM E 647-00. The results are shown plotted in FIG. 20.

Example 12

Fabrication of Shaped Titanium Alloy Casting

An isotropic graphite mold with two split halves was machined with a mold cavity suitable for casting a prototype titanium alloy casting part such as an airframe hinge in accordance with the scope of the present invention. FIG. 21 shows the isotropic graphite mold for casting an airframe hinge of titanium alloy as a net shaped part.

A titanium alloy having the composition Ti-6Al-4V (wt %) was vacuum induction melted in an water cooled copper crucible. The molten alloy was gravity poured into the above mentioned isotropic graphite mold. The casting taken out from the mold cavity showed no reaction between the mold wall and the titanium alloys. FIG. 22 shows the titanium airframe hinge casting which exhibited good surface quality and integrity.

FIG. 23 shows uniform microstructure of the hinge casting made according to the process as stated above in an isotropic graphite mold. FIGS. 24A and 24B show the microstructures, developed by standard optical metallographic techniques, of the hinge casting near the graphite mold-metal interface. The microstructures developed at two different magnifications showed no evidence of alpha case which is a hard oxygen enriched layer.

FIG. 25 shows the microhardness profile of the titanium hinge casting as a function of depth near the outer surface of the Ti-6Al-4V hinge casting made in an isotropic graphite mold. The microhardness from the interior of the sample going towards the edge (i.e. the mold—metal interface) did not show any change which is evidence of absence of hard alpha case that normally forms due to detrimental reaction between conventional ceramic molds and titanium melt during investment casting process.

It should be apparent that in addition to the above-described embodiments, other embodiments other embodiments are also encompassed by the spirit and scope of the present invention. Thus, the present invention is not limited by the above-provided description, but rather is defined by the claims appended hereto.

What is claimed is:

1. A method of making cast shapes of a metallic alloy, comprising the steps of:

melting the alloy under vacuum or partial pressure of inert gas;

pouring the alloy into a mold with a cavity, wherein the mold is made of machined graphite, wherein the graphite has been isostatically or vibrationally molded and has ultra fine isotropic grains having a particle size in the range of 3 to 40 microns, a density between 1.65 and 1.9 grams/cc, flexural strength between 5,500 and 20,000 psi, compressive strength between 9,000 and 35,000 psi, and porosity below 15%;

solidifying the melted alloy into a solid body taking the shape of the mold cavity.

2. The method of claim 1, wherein the mold has a temperature between 100 and 800° C. when the alloy is poured into the mold.

3. The method of claim 1, wherein the mold has a temperature between 150 and 800° C. when the alloy is poured into the mold.

4. The method of claim 1, wherein the mold has a temperature between 200 and 800° C. when the alloy is poured into the mold.

5. The method of claim 1, wherein the mold has a temperature between 150 and 450° C. when the alloy is poured into the mold.

6. The method of claim 1, wherein the mold has a temperature between 250 and 450° C. when the alloy is poured into the mold.

7. The method of claim 1, wherein the metallic alloy is a nickel base superalloy, nickel-iron base superalloy and cobalt base superalloy.

8. The method of claim 1, wherein the metallic alloy is a nickel base superalloy containing 10–20% Cr, up to about 8% Al and/or Ti, and one or more elements in 0.1–12% total such as B, C and/or Zr, as well as 0.1–12% total of one or more alloying elements such as Mo, Nb, W, Ta, Co, Re, Hf, and Fe, and inevitable impurity elements, wherein the impurity elements are less than 0.05% each and less than 0.15% total.

9. The method of claim 1, wherein the metallic alloy is a cobalt base superalloys containing 10–30% Cr, 5–25% Ni and 2–15% W and 0.1–12% total of one or more other elements such as Al, Ti, Nb, Mo, Fe, C, Hf, Ta, and Zr, and inevitable impurity elements, wherein the impurity elements are less than 0.05% each and less than 0.15% total.

10. The method of claim 1, wherein the metallic alloy is a nickel-iron base superalloy containing 25–45% Ni, 37–64% Fe, 10–15% Cr, 0.5–3% Al and/or Ti, and 0.1–12% total of one or more elements selected from the group consisting of B, C, Mo, Nb, and W, as well as inevitable impurity elements, wherein the impurity elements are less than 0.05% each and less than 0.15% total.

11. The method of claim 1, wherein the metallic alloy is a stainless steel alloy based on Fe, containing 10–30% Cr and 5–25% Ni, and small amounts (0.1–12% ) of one or more other elements such as Mo, Ta, W, Ti, Al, Hf, Zr, Re, C, B and V, and inevitable impurity elements, wherein the impurity elements are less than 0.05% each and less than 0.15% total.

12. The method of claim 1, wherein the metallic alloy is based on titanium and contains at least about 50% Ti and at least one other element selected from the group consisting of Al, V, Cr, Mo, Sn, Si, Zr, Cu, C, B, Fe and Mo, and inevitable impurity elements, wherein the impurity elements are less than 0.05% each and less than 0.15% total.

13. The method of claim 1, wherein the metallic alloy is titanium aluminide based on titanium and aluminum and containing 50–85% titanium, 15–36% Al, and at least one other element selected from the group consisting of Cr, Nb, V, Mo, Si and Zr and inevitable impurity elements, wherein the impurity elements are less than 0.05% each and less than 0.15% total.

14. The method of claim 1, wherein the metallic alloy containing at least 50% zirconium and at least one other element selected from the group consisting of Al, V, Mo, Sn, Si, Ti, Hf, Cu, C, Fe and Mo and inevitable impurity elements, wherein the impurity elements are less than 0.05% each and less than 0.15% total.

15. The method of claim 1, wherein the metallic alloy is nickel aluminide containing at least 50% nickel, 20–40% Al and optionally at least one other element selected from the group consisting of V, Si, Zr, Cu, C, Fe and Mo and inevitable impurity elements, wherein the impurity elements are less than 0.05% each and less than 0.15% total.

16. The method of claim 1, wherein the alloy is melted by a method selected from the group consisting of vacuum induction melting and plasma arc remelting.

17. The method of claim 1, wherein the mold has been isostatically molded.

18. The method of claim 17, wherein the graphite of the mold has isotropic grains with grain size between 3 and 10 microns, and the mold has flexural strength of 7,000 to 20,000 psi, compressive strength between 12,000 and 35,000 psi, and porosity below 13%.

19. The method of claim 17, wherein the mold has a density between 1.77 and 1.9 grams/cc and compressive strength between 17,000 psi and 35,000.

20. The method of claim 17, wherein the mold comprises copper impregnated graphite.

21. The method of claim 1, wherein the mold has been vibrationally molded.

22. The method of claim 1, wherein the mold has a SiC coating defining the cavity.

* * * * *